US009964371B1

(12) United States Patent
Huang et al.

(10) Patent No.: US 9,964,371 B1
(45) Date of Patent: May 8, 2018

(54) CHARGING HANDLE ASSEMBLY

(71) Applicants: George Huang, Henderson, NV (US); Eli S. Brandt, Henderson, NV (US)

(72) Inventors: George Huang, Henderson, NV (US); Eli S. Brandt, Henderson, NV (US)

(73) Assignee: BATTLEARMS IP, LLC, Henderson, NV (US)

( * ) Notice: Subject to any disclaimer, the term of this patent is extended or adjusted under 35 U.S.C. 154(b) by 0 days. days.

(21) Appl. No.: 15/805,132

(22) Filed: Nov. 6, 2017

Related U.S. Application Data

(63) Continuation-in-part of application No. 15/450,754, filed on Mar. 6, 2017, now Pat. No. 9,810,494, which is a continuation of application No. 15/001,000, filed on Jan. 19, 2016, now Pat. No. 9,587,896.

(60) Provisional application No. 62/105,274, filed on Jan. 20, 2015.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC .... F41A 3/72; F41A 3/20; F41A 35/06; F41A 7/00; F41A 7/02; F41A 9/00; F41A 9/38
See application file for complete search history.

(56) References Cited

U.S. PATENT DOCUMENTS

| | | | | |
|---|---|---|---|---|
| 7,240,600 | B1 * | 7/2007 | Bordson | F41A 3/72 42/69.01 |
| 7,707,921 | B1 * | 5/2010 | Hoel | F41A 35/06 42/16 |
| 7,832,322 | B1 * | 11/2010 | Hoel | F41A 35/06 42/16 |
| 8,336,436 | B2 * | 12/2012 | Kincel | F41A 35/06 42/16 |
| 8,356,537 | B2 * | 1/2013 | Kincel | F41A 3/72 42/16 |
| D738,452 | S * | 9/2015 | Underwood | D22/108 |
| 9,222,738 | B2 * | 12/2015 | Asher | F41A 35/06 |
| D749,687 | S * | 2/2016 | Warensford | D22/108 |
| 2011/0174139 | A1 * | 7/2011 | Olsen | F41A 3/72 89/1.4 |
| 2013/0092014 | A1 * | 4/2013 | Kincel | F41A 3/72 89/1.4 |
| 2014/0060293 | A1 * | 3/2014 | Gomez | F41A 3/72 89/1.4 |
| 2014/0318356 | A1 * | 10/2014 | Cupps | F41A 3/72 89/1.4 |

* cited by examiner

*Primary Examiner* — Benjamin P Lee
(74) *Attorney, Agent, or Firm* — Shaddock Law Group, PC

(57) ABSTRACT

A charging handle having a charging handle body including a base portion; a handle element slidably and at least partially rotatable relative to said base portion; and a latch element slidable and at least partially rotatable relative to said handle element, and wherein at least a portion of said latch element is formed so as to interact with at least a portion of said handle recess such that rotational or longitudinal movement of said handle element relative to a longitudinal axis of said charging handle produces lateral, translational movement of said latch element relative to said charging handle body.

20 Claims, 44 Drawing Sheets

CHARGING HANDLE ASSEMBLY

CROSS-REFERENCE TO RELATED APPLICATIONS

This patent application is a Continuation-In-Part of U.S. patent application Ser. No. 15/450,754, filed Nov. 7, 2017, now U.S. Pat. No. 9,810,494, which is a Continuation of U.S. patent application Ser. No. 15/001,000, filed Jan. 19, 2016, now U.S. Pat. No. 9,587,896, which claims the benefit of U.S. Patent Application Ser. No. 62/105,274, filed Jan. 20, 2015, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an ambidextrous charging handle adaptable to be used with a firearm, such as the AR-15, M4, and the like.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a charging handle, located at top and substantially parallel to the bolt of the firearm, to manipulate the bolt and open the firearm's action and/or manually load a cartridge into the firearm's chamber.

The typical charging handle comprises an elongate portion of material that extends from a substantially T-shaped rear handle to a forward end adapted to engage the firearms bolt.

A spring-loaded, pivoting latch includes a hook or claw that engages a recess in the upper receiver of the firearm, to maintain the charging handle in a closed position relative to the upper receiver of the firearm. The pivoting latch is typically located on the left side of the charging handle and when the spring bias of the pivoting latch is overcome, by a user pulling reward on the left side of the charging handle, engaging the pivoting latch, the latch pivots to an unlocked position and allows the user to pull the charging handle rearward to manipulate the bolt.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Initially, the latch could only be manipulated from the left side of the firearm. Over time, modify charging handles have been developed that include an ambidextrous latch mechanism that allows the latch to be manipulated using a lever located on the right and/or left side of the charging handle. However, known ambidextrous charging handles utilize multiple pivot pins and a pivot at multiple points. Additionally, known ambidextrous charging handles typically include a combined latch and lever, wherein the latch (including the hook or claw) is an integral component of at least one of the levers. This results in an overly complicated design, which is prone to failure at multiple points.

The disadvantages and shortcomings of the prior art are overcome by the features and elements of the ambidextrous charging handle of the present disclosure. The advantages of the present disclosure are preferably attained by providing, in a first, exemplary, nonlimiting embodiment, an ambidextrous charging handle that comprises a charging handle body, a lever element, a latch element, and a spring biasing element.

The charging handle body comprises an elongate portion of material that extends along a longitudinal axis from a substantially T-shaped rear handle to a forward end having a bolt engagement element. The T-shaped rear handle includes a right handle portion and a left handle portion and a handle recess formed so as to slidably receive at least a portion of a lever element. The handle recess includes a slide pin or slide protrusion extending from a bottom wall of the handle recess.

The lever element comprises an elongate portion of material that includes a lever recess formed in a forward portion of the lever element. In various exemplary embodiments, the lever recess is formed at an obtuse angle, e, relative to a longitudinal axis of the lever element. An elongate lever channel is formed through a portion of the lever element from a top side to a bottom side, perpendicular to the longitudinal axis of the lever element. The lever channel is shaped so as to interact with the slide pin or slide protrusion to enable the lever element to be slidable forward and rearward, relative to the longitudinal axis of the charging handle, within the handle recess.

The latch element extends from a first portion to a second portion and a claw (including a ramp surface and shoulder) is formed proximate the first portion of the latch element. A latch protrusion is formed proximate the second portion of the latch element. The latch protrusion is formed so as to interact with the lever recess such that movement of the lever element along the longitudinal axis of the charging handle produces lateral (side-to-side), non-pivoting, movement of the latch element relative to the longitudinal axis of the charging handle.

The spring biasing element interacts between an interior side wall of the charging handle body and the lever element to bias the lever element in a forward or locked position. As the lever element is urged rearward, from either the right handle portion or the left handle portion of the charging handle body, the spring bias of the spring biasing element can be overcome to move the latch element from the locked to unlocked position.

In an exemplary, nonlimiting embodiment, the ambidextrous charging handle comprises a charging handle body, a latch element, a first lever element, a second lever element, and a spring biasing element.

The charging handle body comprises an elongate portion of material that extends along a longitudinal axis from a rear handle portion to a forward end having a bolt engagement element. The rear handle portion includes a handle recess formed so as to pivotably receive at least a portion of the latch element, the first lever element, the second lever element, and the spring biasing element. The handle recess includes a slide pin or slide protrusion extending from a bottom wall of the handle recess. Additionally, a camming element extends from the bottom wall of the handle recess.

The latch element extends from a first portion to a second portion and a claw (including a ramp surface and shoulder) is formed proximate the first portion of the latch element. A primary latch protrusion is formed proximate the second portion of the latch element, in a top portion of the latch element, while a secondary latch protrusion is formed proximate the second portion of the latch element, in a bottom portion of the latch element.

The first lever element comprises an elongate portion of material that extends from a latch engagement portion to a finger engagement portion. A slide pin aperture is formed through the latch engagement portion, such that when the slide pin aperture interacts with the slide protrusion, the first lever element is able to be pivoted from a locked position to an unlocked position. The first lever element includes a curved, camming surface formed so as to interact with a secondary latch protrusion of the latch element. A spring engagement protrusion extends from a portion of the first lever element so as to engage and interact with the spring biasing element.

The second lever element comprises an elongate portion of material that also extends from a latch engagement portion to a finger engagement portion. A slide pin aperture is formed through the latch engagement portion, such that when the slide pin aperture interacts with the slide protrusion, the second lever element is able to be pivoted from a locked position to an unlocked position. The second lever element includes a lever recess formed so as to interact with a primary latch protrusion of the latch element. A spring engagement protrusion extends from a portion of the second lever element so as to engage and interact with the spring biasing element.

The primary latch protrusion is formed so as to interact with the lever recess of the second lever element such that rotation of the second lever element about the slide protrusion produces lateral movement of the latch element relative to the longitudinal axis of the charging handle.

The secondary latch protrusion is formed so as to interact with the camming surface of the first lever element such that rotation of the first lever element about the slide protrusion also produces lateral movement of the latch element relative to the longitudinal axis of the charging handle. When the camming surface of the first lever element produces movement of the latch element (via interaction of the secondary latch protrusion and the camming surface), the primary latch protrusion interacts with the lever recess of the second lever element to produce rotational movement of the second lever element.

The spring biasing element interacts between the spring engagement protrusion of the first lever element and the spring engagement protrusion of the second lever element to bias the first lever element and the second lever element against one another in a forward or locked position. As the first lever element and/or the second lever element is urged rearward, the spring bias of the spring biasing element can be overcome to move the latch element from the locked to unlocked position.

In various exemplary, nonlimiting embodiments, the latch element is positioned such that movement of the handle element along the longitudinal axis of the charging handle (forward and backward) produces lateral (side-to-side), non-pivoting, movement of the latch element relative to the longitudinal axis of the charging handle. Additionally, movement of one side or the other side of the handle element rearward (rotational movement of the handle element), relative to the longitudinal axis of the charging handle, also produces lateral (side-to-side), non-pivoting, movement of the latch element relative to the longitudinal axis of the charging handle.

In various exemplary, nonlimiting embodiments, the charging handle assembly comprises at least some of a charging handle body that extends from a base portion; a handle element, wherein the handle element is attached or coupled to the base portion of the charging handle body, such that the handle element is repeatably slidable relative to the base portion of the charging handle body and is also at least partially rotatable relative to the base portion of the charging handle body; and a latch element having an elongate pivot aperture formed therethrough, wherein the latch element is repeatably slidable relative to the handle element and is also at least partially rotatable relative to the handle element, and wherein at least a portion of the latch element is formed so as to interact with at least a portion of said handle recess such that rotational or longitudinal movement of said handle element relative to a longitudinal axis of said charging handle produces lateral, translational movement of said latch element relative to said charging handle body.

In various exemplary, nonlimiting embodiments, rotational movement of said latch element does not induce movement of said handle element.

In various exemplary, nonlimiting embodiments, the charging handle body comprises an elongate portion of material that extends along said longitudinal axis from said base portion to a forward end having a bolt engagement element.

In various exemplary, nonlimiting embodiments, the charging handle further includes a first spring biasing element that biases said handle element toward a locked position.

In various exemplary, nonlimiting embodiments, the charging handle further includes a second spring biasing element that biases said latch element toward a locked position.

In various exemplary, nonlimiting embodiments, the handle element is attached or coupled to the base portion of the charging handle body via interaction of a pin positioned through an elongate aperture formed through a portion of the base portion and attached or coupled to the handle element.

In various exemplary, nonlimiting embodiments, the elongate aperture formed through a portion of the base portion is formed so as to have a longitudinal axis that is substantially parallel to the longitudinal axis of the charging handle body.

In various exemplary, nonlimiting embodiments, the charging handle further includes a first stop protrusion and a second stop protrusion, wherein the first stop protrusion and the second stop protrusion extend from at least a portion of the base portion so as to interact with the handle element to limit forward or rotational movement of the handle element relative to the base portion.

In various exemplary, nonlimiting embodiments, the base portion is a substantially T-shaped base portion.

In various exemplary, nonlimiting embodiments, the charging handle assembly comprises at least some of a charging handle body extending from a base portion; a handle element attached or coupled to the base portion, such that the handle element is repeatably slidable relative to the base portion and is also at least partially rotatable relative to the base portion; and a latch element having an elongate pivot aperture formed therethrough, wherein the latch element is repeatably slidable relative to the handle element and is also at least partially rotatable relative to the handle element, and wherein at least a portion of the latch element is formed so as to interact with at least a portion of said handle recess such that rotational or longitudinal movement of said handle element relative to a longitudinal axis of said charging handle produces lateral, translational movement of said latch element relative to said charging handle body.

In various exemplary, nonlimiting embodiments, the charging handle assembly comprises at least some of a charging handle body having a base portion; a handle element slidably and at least partially rotatable relative to the base portion; and a latch element slidable and at least partially rotatable relative to the handle element, and wherein at least a portion of the latch element is formed so as to interact with at least a portion of said handle recess such that rotational or longitudinal movement of said handle element relative to a longitudinal axis of said charging handle produces lateral, translational movement of said latch element relative to said charging handle body.

Accordingly, the present disclosure separately provides an improved ambidextrous charging handle for firearms.

The present disclosure separately provides an improved ambidextrous charging handle for firearms having a simplified design.

The present disclosure separately provides an improved ambidextrous charging handle for firearms, which provides ambidextrous functions with a single slide pin or slide protrusion.

The present disclosure separately provides an improved ambidextrous charging handle for firearms having a latch element that moves from a locked to an unlocked position in a lateral or linear, nonrotating, fashion.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the disclosure discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of what may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF THE INVENTION

For simplicity and clarification, the design factors and operating principles of the ambidextrous charging handle according to an exemplary embodiment of the present disclosure are explained with reference to various exemplary embodiments of an ambidextrous charging handle according to an exemplary embodiment of the present disclosure. The basic explanation of the design factors and operating principles of the ambidextrous charging handle is applicable for the understanding, design, and operation of the ambidextrous charging handle of the present disclosure. It should be appreciated that the ambidextrous charging handle can be adapted to many applications where an ambidextrous charging handle or strap can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "ambidextrous charging handle", "latch element", and "lever element" are used for basic explanation and understanding of the operation of the systems, methods, and apparatuses of the present disclosure. Therefore, the terms "ambidextrous charging handle", "latch element", and "lever element" are not to be construed as limiting the systems, methods, and apparatuses of the present disclosure.

Figure 33:
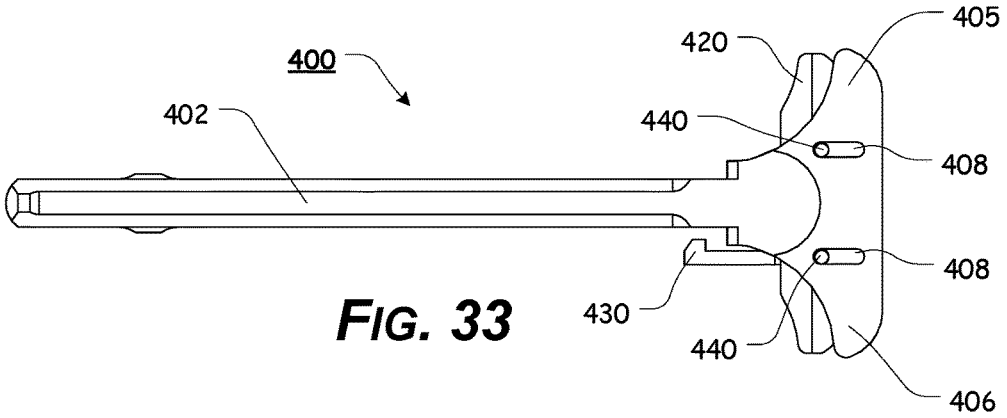
FIG. 33 illustrates a top view of an exemplary embodiment of an ambidextrous charging handle, wherein the latch element is in the locked position, according to an exemplary embodiment of the present disclosure.
Figure 34:
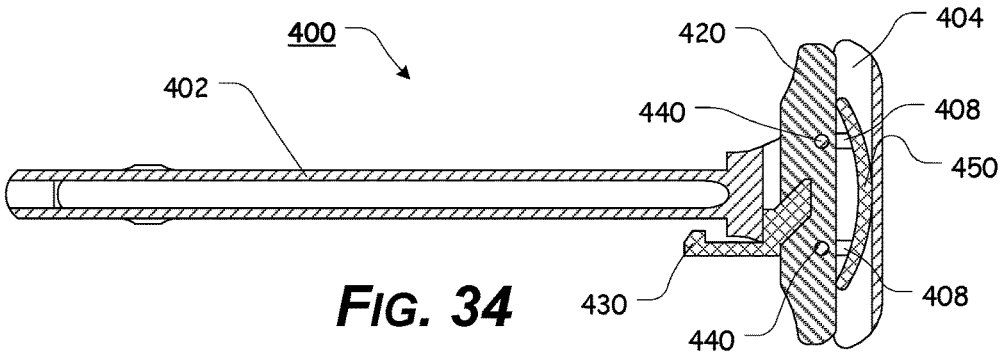
FIG. 34 illustrates a top, cross-sectional view of an exemplary embodiment of an ambidextrous charging handle, wherein the latch element is in the locked position, according to an exemplary embodiment of the present disclosure.
Figure 35:
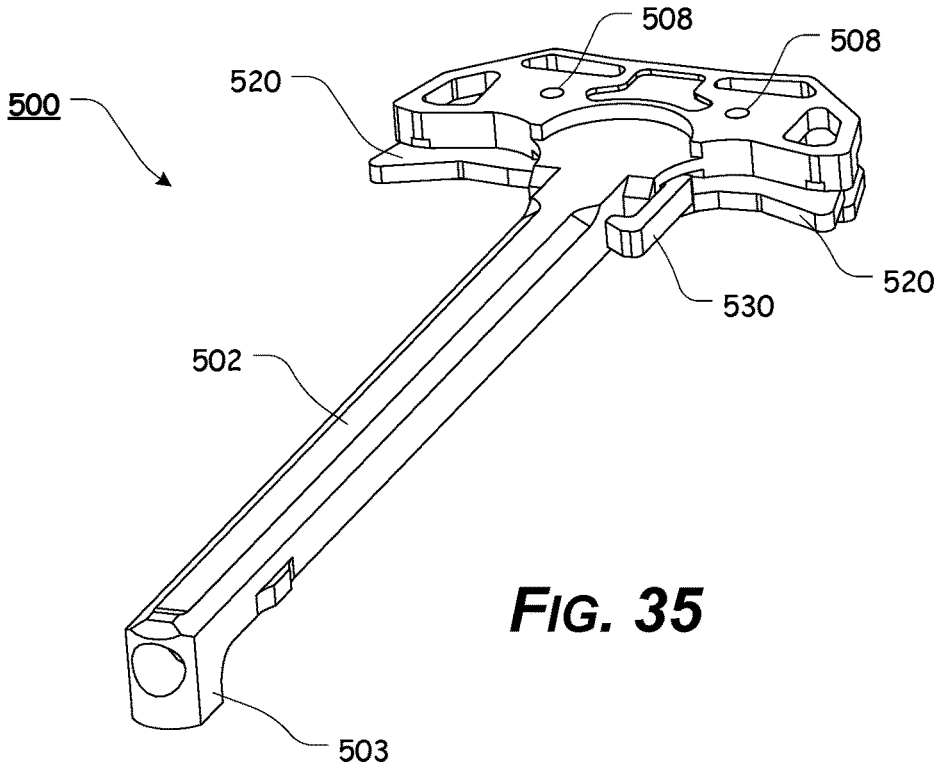
FIG. 35 illustrates a front perspective view of an exemplary embodiment of an ambidextrous charging handle, according to an exemplary embodiment of the present disclosure.
Figure 36:
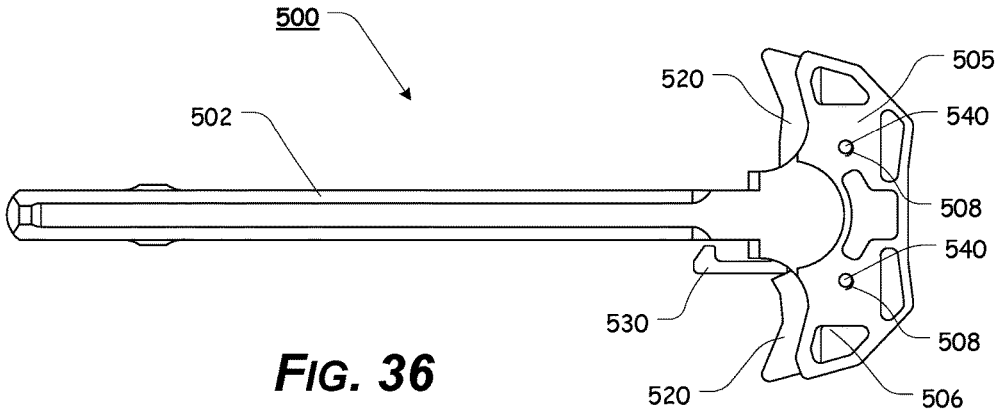
FIG. 36 illustrates a top view of an exemplary embodiment of an ambidextrous charging handle, according to an exemplary embodiment of the present disclosure.
Figure 37:
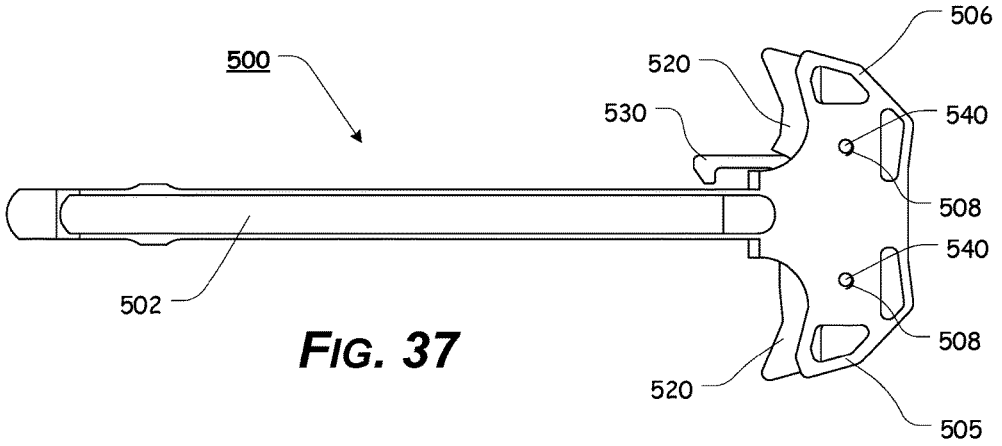
FIG. 37 illustrates a bottom view of an exemplary embodiment of an ambidextrous charging handle, according to an exemplary embodiment of the present disclosure.
Figure 38:
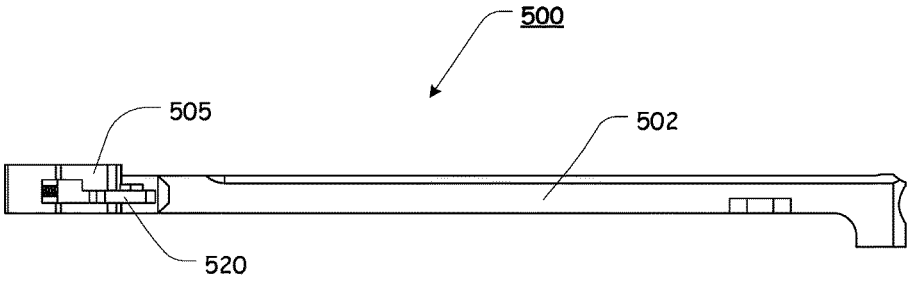
FIG. 38 illustrates a right side view of an exemplary embodiment of an ambidextrous charging handle, according to an exemplary embodiment of the present disclosure.
Figure 39:
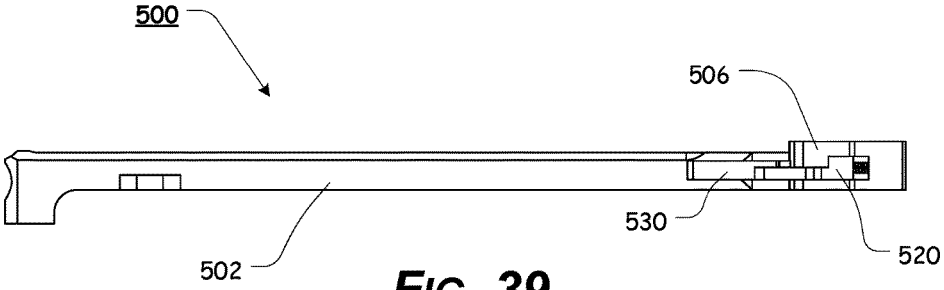
FIG. 39 illustrates a left side view of an exemplary embodiment of an ambidextrous charging handle, according to an exemplary embodiment of the present disclosure.
Figure 40:
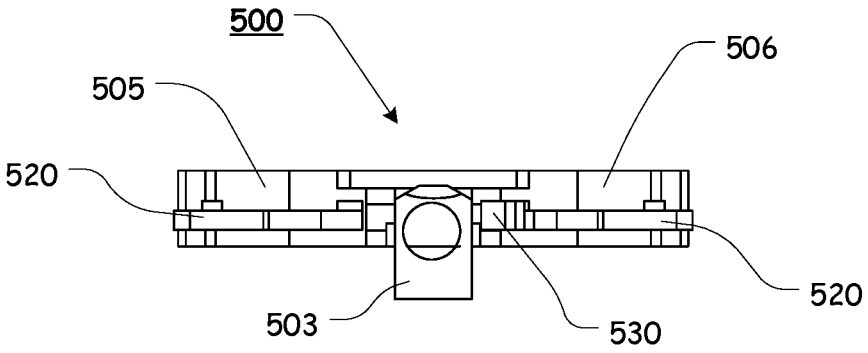
FIG. 40 illustrates a front view of an exemplary embodiment of an ambidextrous charging handle, according to an exemplary embodiment of the present disclosure.
Figure 41:
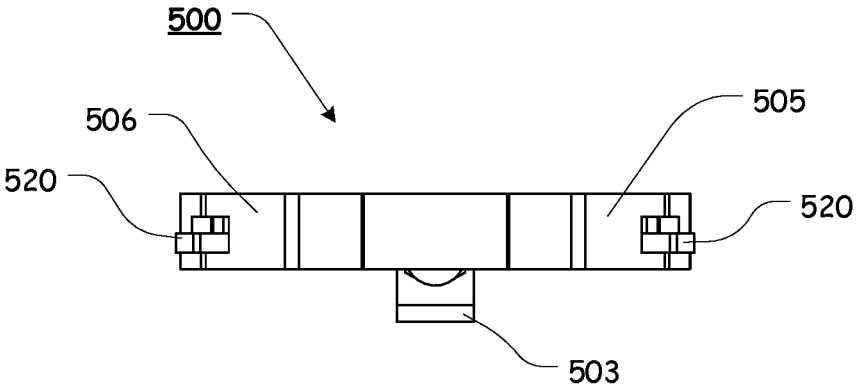
FIG. 41 illustrates a rear view of an exemplary embodiment of an ambidextrous charging handle, according to an exemplary embodiment of the present disclosure.
Figure 42:
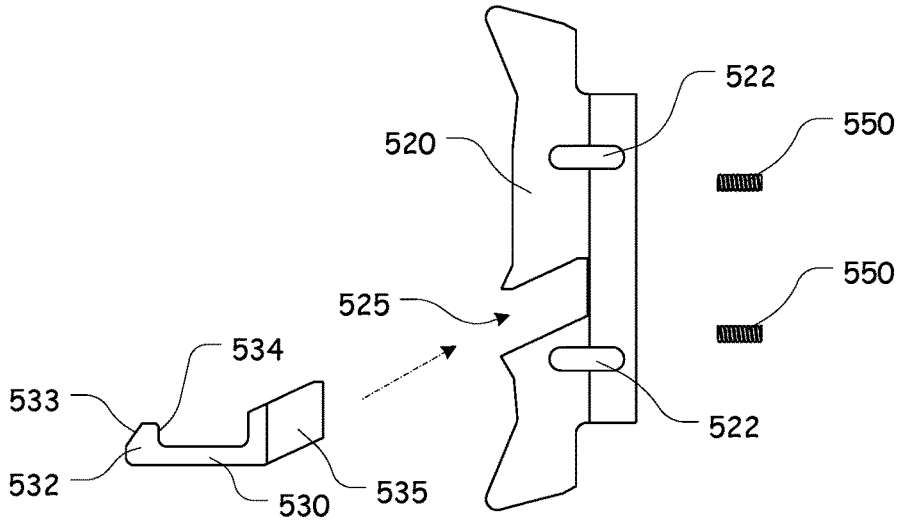
FIG. 42 illustrates a top view of an exemplary embodiment of the lever element, the latch element, and the spring biasing element of an ambidextrous charging handle, according to an exemplary embodiment of the present disclosure.
Figure 43:
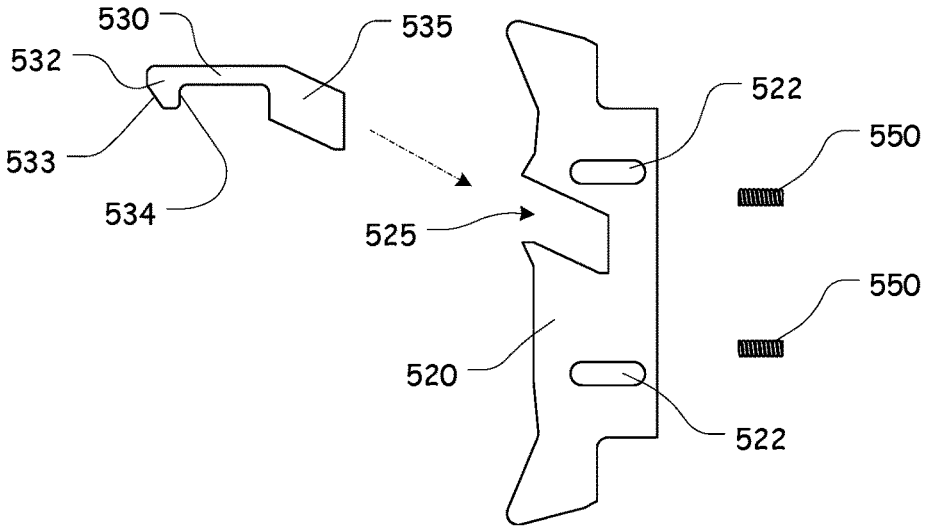
FIG. 43 illustrates a bottom view of an exemplary embodiment of the lever element, the latch element, and the spring biasing element of an ambidextrous charging handle, according to an exemplary embodiment of the present disclosure.
Figure 44:
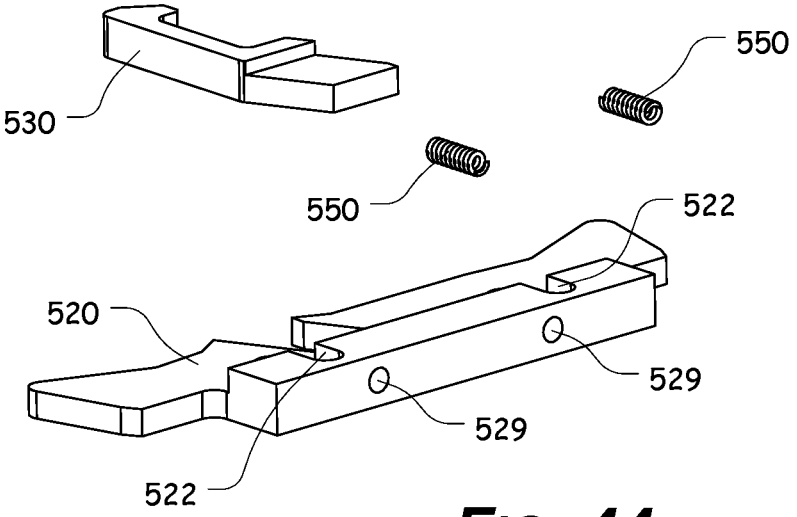
FIG. 44 illustrates an exploded, perspective view of an exemplary embodiment of the lever element, the latch element, and the spring biasing element of an ambidextrous charging handle, according to an exemplary embodiment of the present disclosure.
Figure 45:
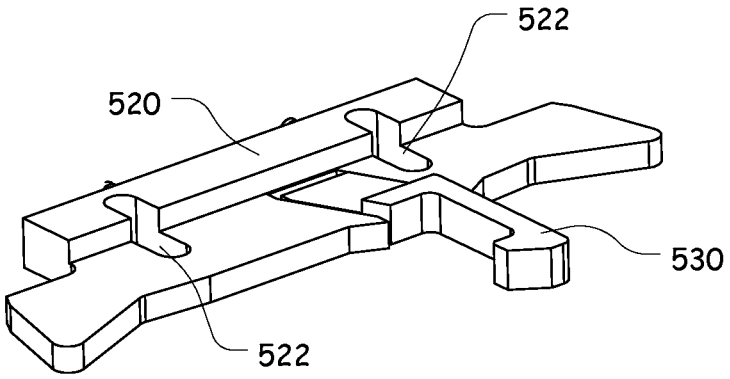
FIG. 45 illustrates an upper, front, perspective view of an exemplary embodiment of the lever element, the latch element, and the spring biasing element of an ambidextrous charging handle, according to an exemplary embodiment of the present disclosure.
Figure 46:
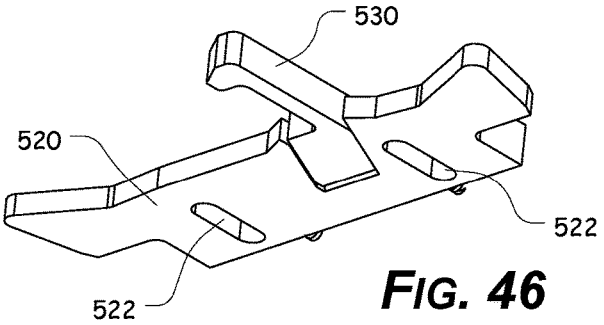
FIG. 46 illustrates a left side, lower, perspective view of an exemplary embodiment of the lever element, the latch element, and the spring biasing element of an ambidextrous charging handle, according to an exemplary embodiment of the present disclosure.
Figure 47:
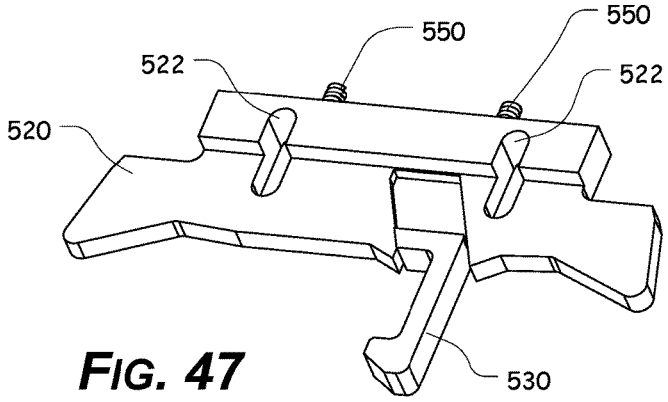
FIG. 47 illustrates a upper, front, perspective view of an exemplary embodiment of the lever element, the latch element, and the spring biasing element of an ambidextrous charging handle, according to an exemplary embodiment of the present disclosure.
Figure 48:
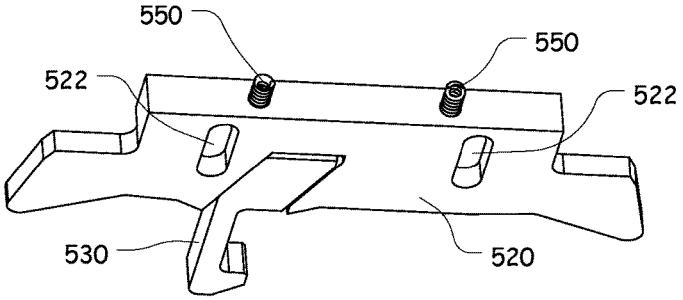
FIG. 48 illustrates a lower, rear, perspective view of an exemplary embodiment of the lever element, the latch element, and the spring biasing element of an ambidextrous charging handle, according to an exemplary embodiment of the present disclosure.
Figure 49:
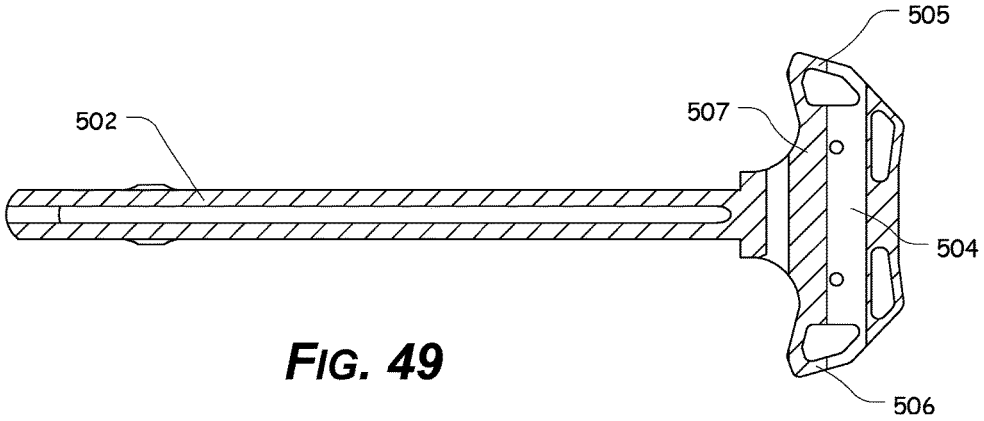
FIG. 49 illustrates a top, cross-sectional view of an exemplary embodiment of the charging handle body, according to an exemplary embodiment of the present disclosure.

Turning now to the drawing FIGS., FIGS. 1-24 illustrate various elements and/or aspects of an exemplary embodiment of the ambidextrous charging handle 100, according to this disclosure. FIGS. 25-28 illustrate various elements and/or aspects of an exemplary embodiment of the ambidextrous charging handle 200, FIGS. 29-32 illustrate various elements and/or aspects of an exemplary embodiment of the ambidextrous charging handle 300, FIGS. 33-34 illustrate various elements and/or aspects of an exemplary embodiment of the ambidextrous charging handle 400, FIGS. 35-46 illustrate various elements and/or aspects of an exemplary embodiment of the ambidextrous charging handle 500, FIGS. 67-75 illustrate an exemplary, nonlimiting embodiment of the ambidextrous charging handle 700, FIGS. 76-79 illustrate an exemplary, nonlimiting embodiment of the ambidextrous charging handle 800, FIGS. 80-85 illustrate an exemplary, nonlimiting embodiment of the ambidextrous charging handle 900, FIGS. 86-98 illustrate an exemplary, nonlimiting embodiment of the ambidextrous charging handle 1000, and FIGS. 99-104 illustrate an exemplary, nonlimiting embodiment of the ambidextrous charging handle 1100, according to this disclosure.

As illustrated in FIGS. 1-24, the exemplary embodiment of the ambidextrous charging handle 100 of the present disclosure comprises a charging handle body 102, a lever element 120, a latch element 130, and a spring biasing element 150.

The charging handle body 102 comprises an elongate portion of material that extends along a longitudinal axis from a substantially T-shaped rear handle to a forward end having a bolt engagement element 103. The T-shaped rear handle includes a right handle portion 105 and a left handle portion 106. A handle recess 104 is formed within the T-shaped rear handle portion and is shaped so as to slidably receive at least a portion of the lever element 120 inside the handle recess 104.

A slide protrusion or slide pin 140 extends from a bottom wall of the handle recess 104. In certain exemplary embodiments, the slide protrusion or slide pin 140 extends from both the bottom wall and a top wall of the handle recess 104. Alternatively, a slide pin aperture 108 may be formed through the charging handle body 102 and the slide protrusion or slide pin 140 may comprise a slide pin 140 positioned within the slide pin aperture 108.

In various exemplary embodiments, the lever element 120 comprises an elongate portion of material that includes a lever recess 125 formed in a forward portion of the lever element 120. In various exemplary embodiments, the lever recess 125 is formed at an obtuse angle, e, relative to a longitudinal axis of the lever element 120.

An elongate lever channel 122 is formed through a portion of the lever element 120 from a top side to a bottom side, perpendicular to the longitudinal axis of the lever element 120. The lever channel 122 is shaped so as to interact with the slide protrusion or slide pin 140 to enable the lever element 120 to be slidable forward and/or rearward, relative to the longitudinal axis of the charging handle 100, within the handle recess 104.

In various exemplary embodiments, slide support surfaces 107 are formed within the handle recess 104 so as to provide support or sliding surfaces for the lever element 120.

The latch element 130 extends from a first portion to a second portion and a claw 132 (including a ramp surface 133 and shoulder 134) is formed proximate the first portion of the latch element 130. A latch protrusion 135 is formed proximate the second portion of the latch element 130. The latch protrusion 135 is formed so as to be at least partially received within and interact with the lever recess 125 such that movement of the lever element 120 along the longitudinal axis of the charging handle 100 (forward and backward) produces lateral (side-to-side), non-pivoting, movement of the latch element 130 relative to the longitudinal axis of the charging handle 100.

Figure 1:
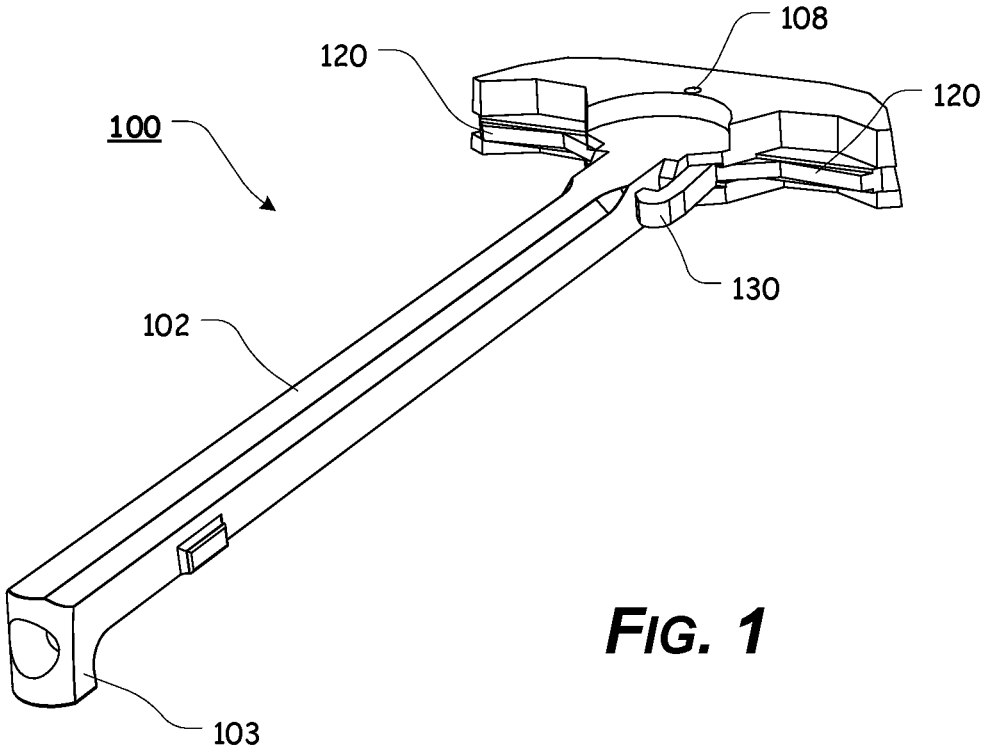
FIG. 1 illustrates a front perspective view of an exemplary embodiment of an ambidextrous charging handle, according to an exemplary embodiment of the present disclosure.
Figure 2:
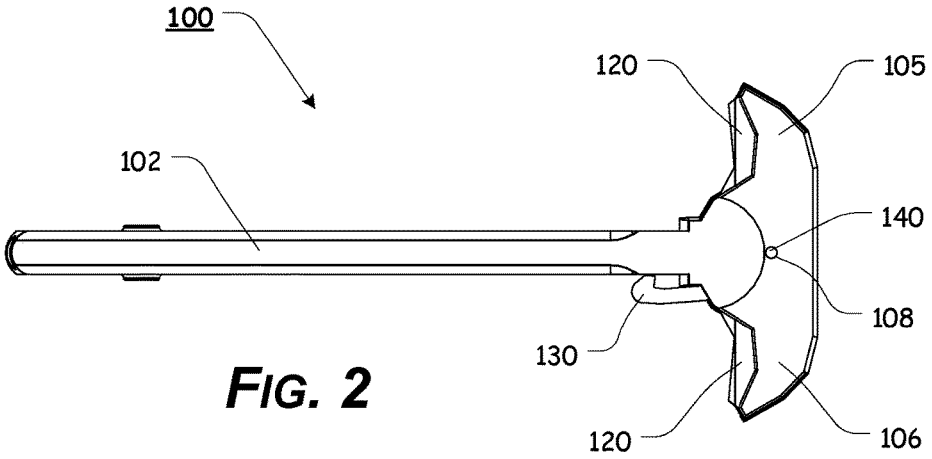
FIG. 2 illustrates a top view of an exemplary embodiment of an ambidextrous charging handle, according to an exemplary embodiment of the present disclosure.
Figure 3:
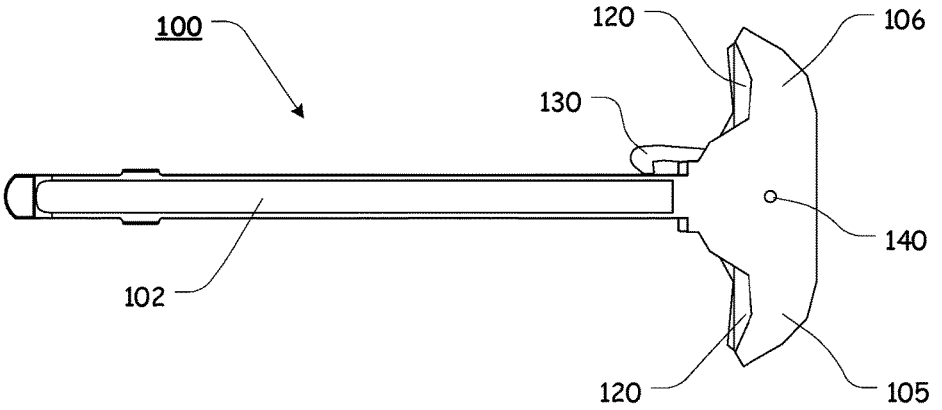
FIG. 3 illustrates a bottom view of an exemplary embodiment of an ambidextrous charging handle, according to an exemplary embodiment of the present disclosure.
Figure 4:
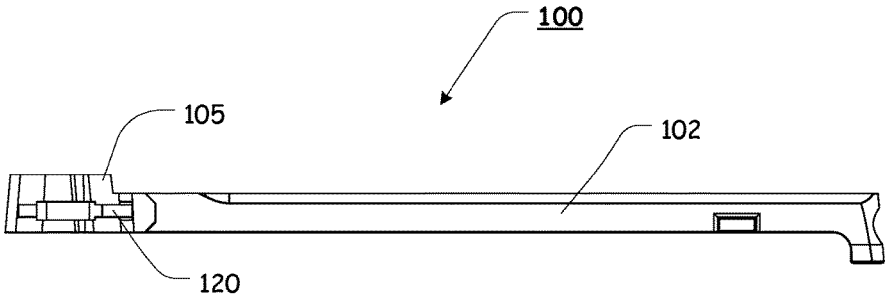
FIG. 4 illustrates a right side view of an exemplary embodiment of an ambidextrous charging handle, according to an exemplary embodiment of the present disclosure.
Figure 5:
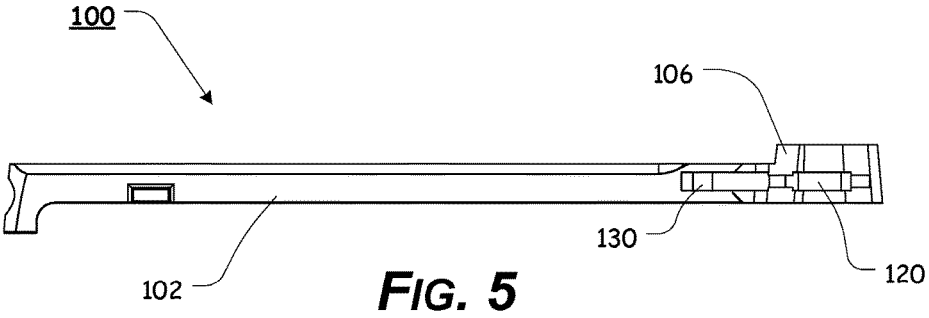
FIG. 5 illustrates a left side view of an exemplary embodiment of an ambidextrous charging handle, according to an exemplary embodiment of the present disclosure.
Figure 6:
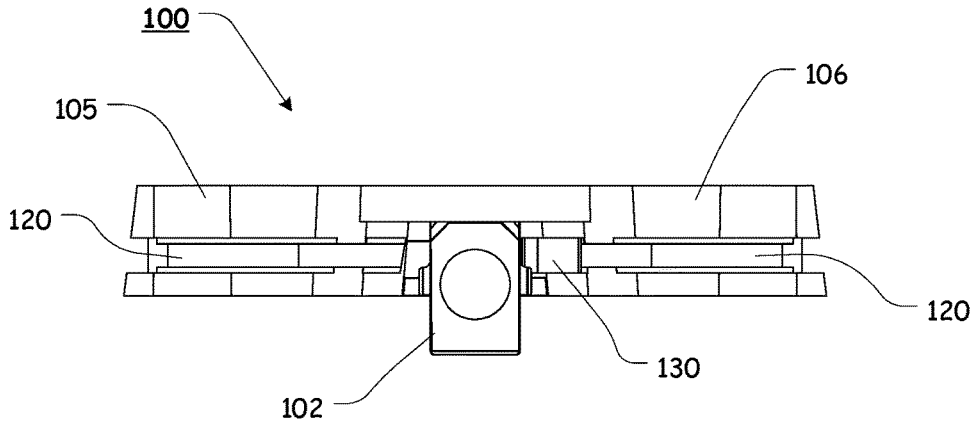
FIG. 6 illustrates a front view of an exemplary embodiment of an ambidextrous charging handle, according to an exemplary embodiment of the present disclosure.
Figure 7:
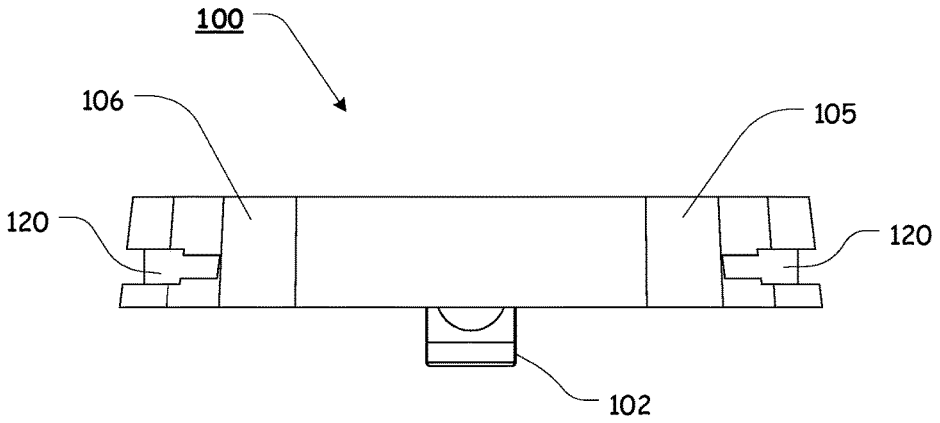
FIG. 7 illustrates a rear view of an exemplary embodiment of an ambidextrous charging handle, according to an exemplary embodiment of the present disclosure.
Figure 8:
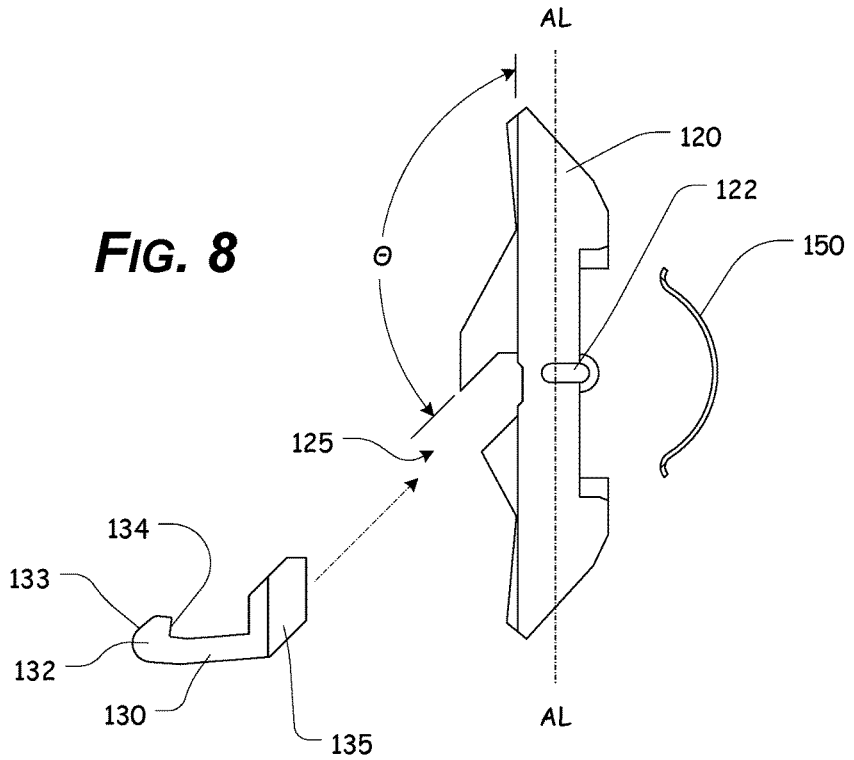
FIG. 8 illustrates a top view of an exemplary embodiment of the lever element, the latch element, and the spring biasing element of an ambidextrous charging handle, according to an exemplary embodiment of the present disclosure.
Figure 9:
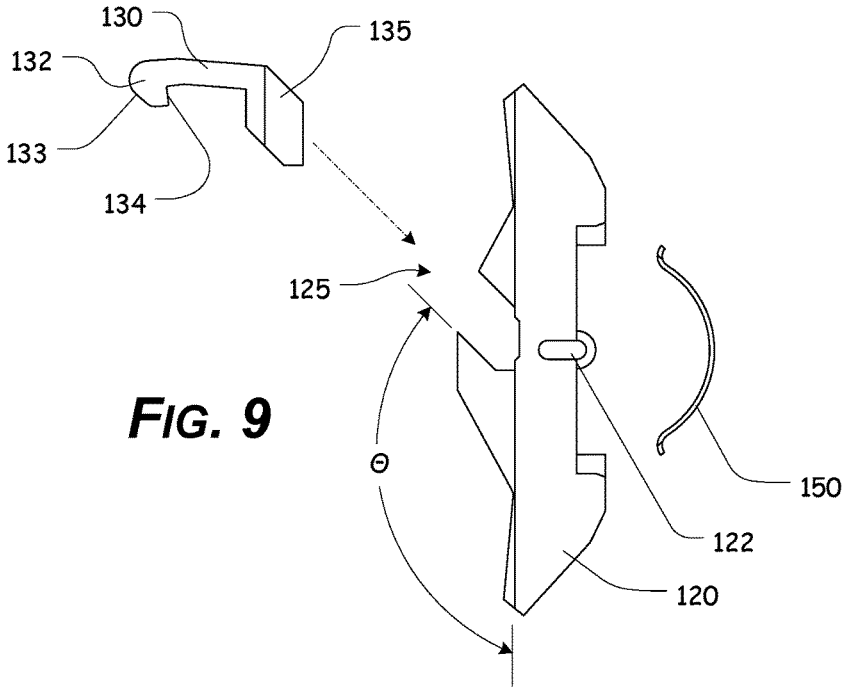
FIG. 9 illustrates a bottom view of an exemplary embodiment of the lever element, the latch element, and the spring biasing element of an ambidextrous charging handle, according to an exemplary embodiment of the present disclosure.
Figure 10:
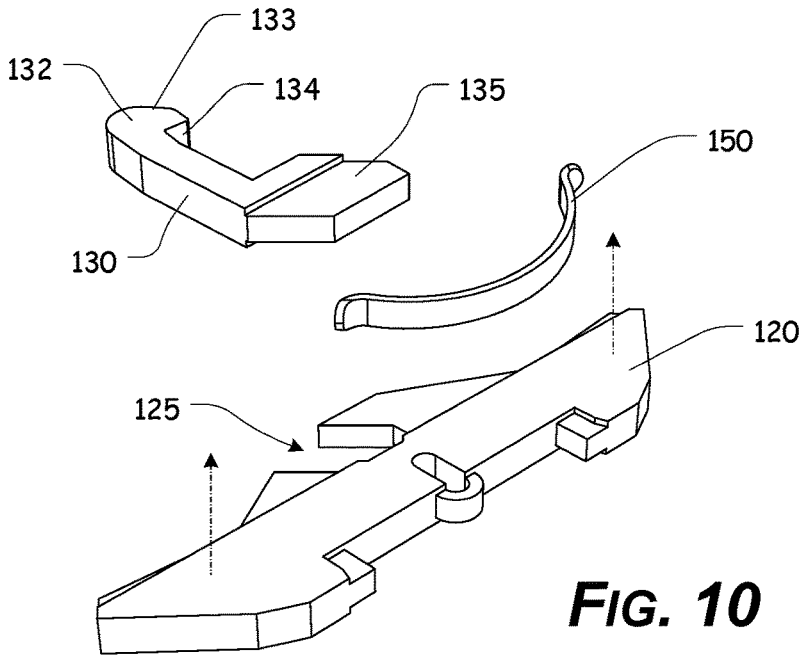
FIG. 10 illustrates an exploded, perspective view of an exemplary embodiment of the lever element, the latch element, and the spring biasing element of an ambidextrous charging handle, according to an exemplary embodiment of the present disclosure.
Figure 11:
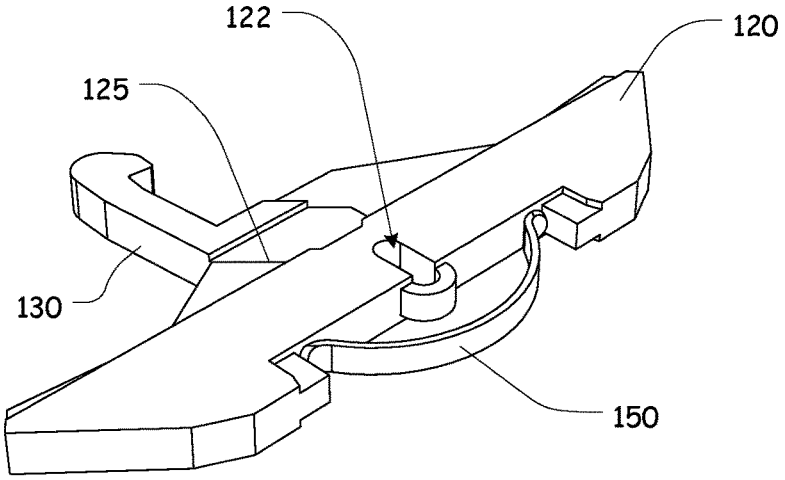
FIG. 11 illustrates an upper, rear, perspective view of an exemplary embodiment of the lever element, the latch element, and the spring biasing element of an ambidextrous charging handle, according to an exemplary embodiment of the present disclosure.
Figure 12:
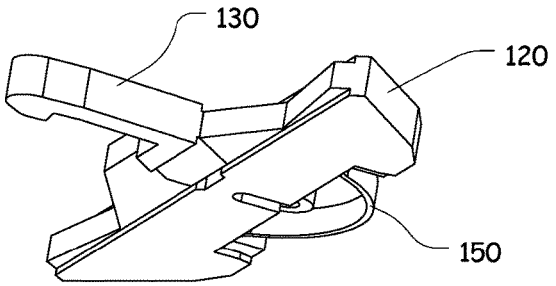
FIG. 12 illustrates a left side, lower, perspective view of an exemplary embodiment of the lever element, the latch element, and the spring biasing element of an ambidextrous charging handle, according to an exemplary embodiment of the present disclosure.
Figure 13:
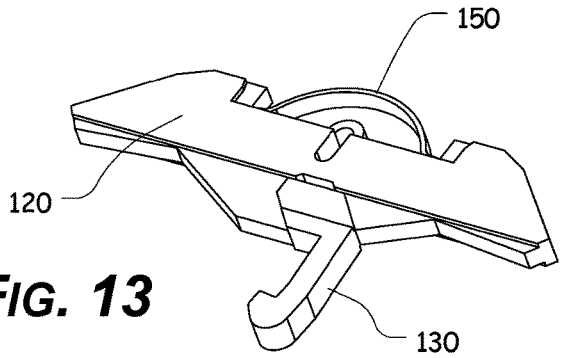
FIG. 13 illustrates a upper, front, perspective view of an exemplary embodiment of the lever element, the latch element, and the spring biasing element of an ambidextrous charging handle, according to an exemplary embodiment of the present disclosure.
Figure 14:
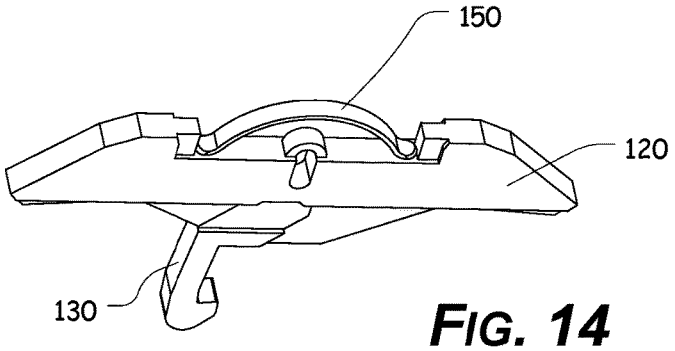
FIG. 14 illustrates a lower, rear, perspective view of an exemplary embodiment of the lever element, the latch element, and the spring biasing element of an ambidextrous charging handle, according to an exemplary embodiment of the present disclosure.
Figure 15:
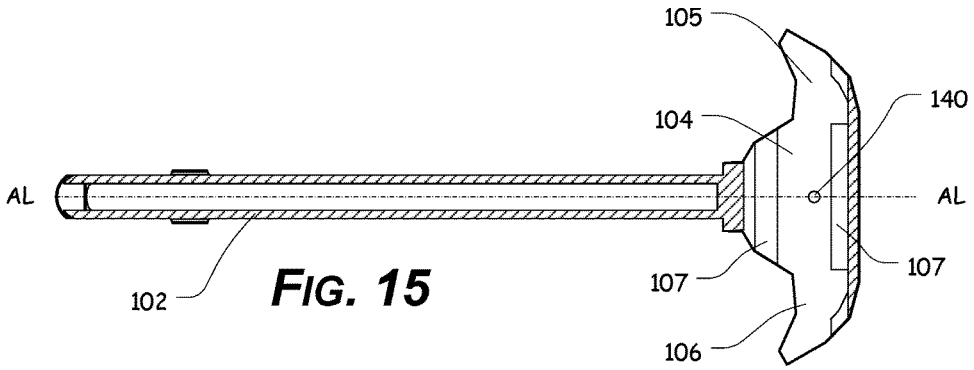
FIG. 15 illustrates a top, cross-sectional view of an exemplary embodiment of the charging handle body, according to an exemplary embodiment of the present disclosure.
Figure 16:
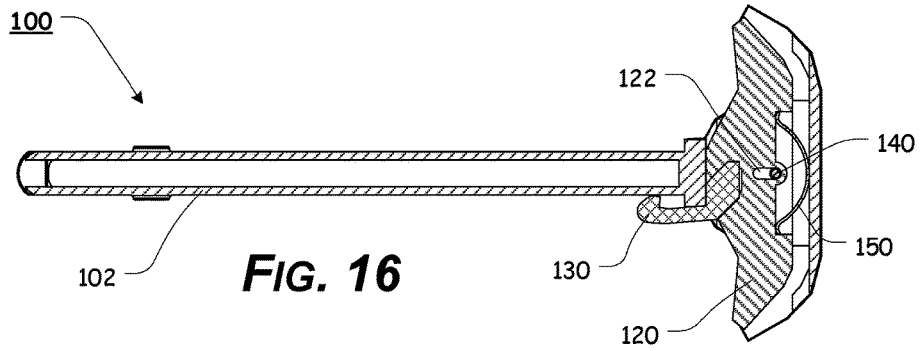
FIG. 16 illustrates a top, cross-sectional view showing various components of an exemplary embodiment of an ambidextrous charging handle, wherein the latch element is in the locked position, according to an exemplary embodiment of the present disclosure.
Figure 17:
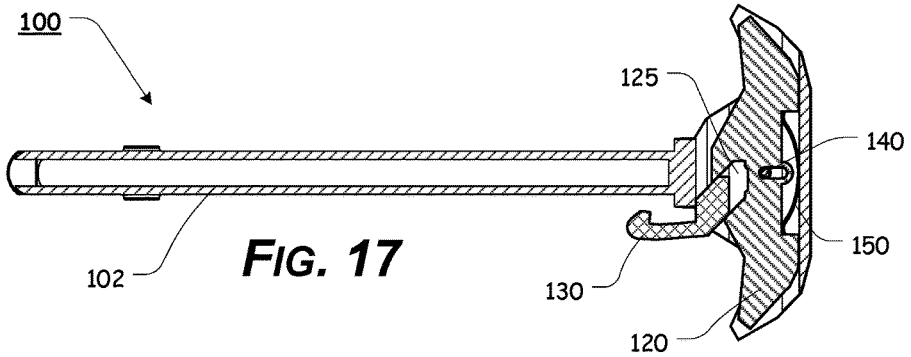
FIG. 17 illustrates a top, cross-sectional view showing various components of an exemplary embodiment of an ambidextrous charging handle, wherein the latch element is in the unlocked position, according to an exemplary embodiment of the present disclosure.
Figure 18:
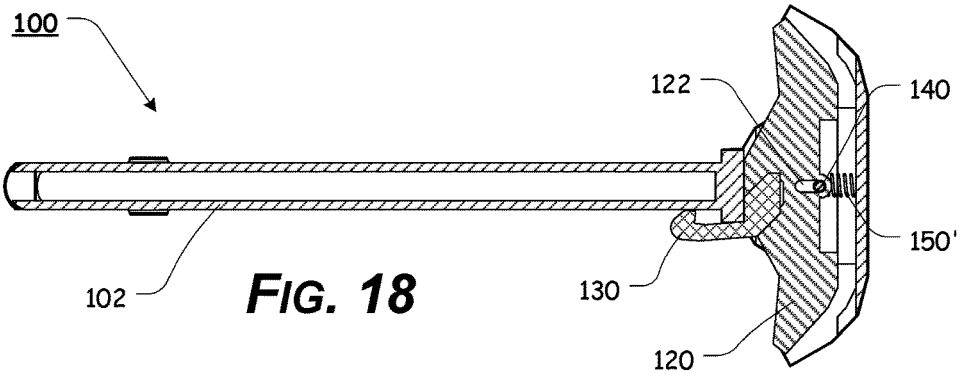
FIG. 18 illustrates a top, cross-sectional view showing various components of an exemplary embodiment of an ambidextrous charging handle, wherein the latch element is in the locked position, according to an exemplary embodiment of the present disclosure.
Figure 19:
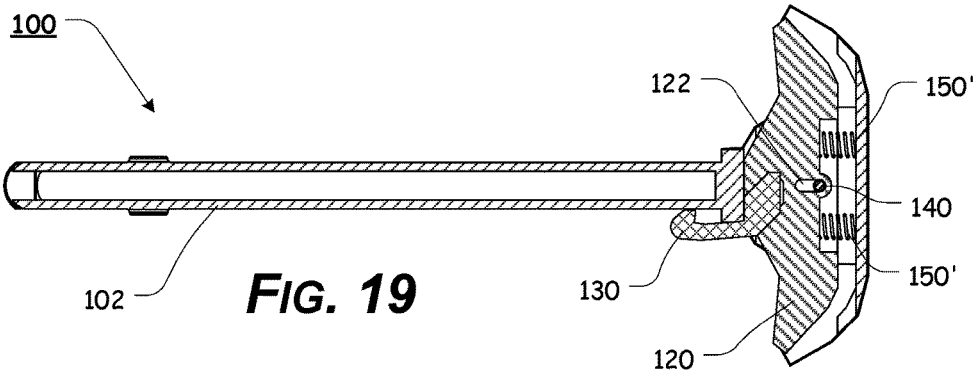
FIG. 19 illustrates a top, cross-sectional view showing various components of an exemplary embodiment of an ambidextrous charging handle, wherein the latch element is in the locked position, according to an exemplary embodiment of the present disclosure.

Because of the relative angles of the interior sidewalls of the lever recess 125 and the exterior sidewalls of the latch protrusion 135, as the lever element 120 is urged from the locked position, as illustrated in FIG. 16, to the unlocked position, as illustrated in FIG. 17, the rearward movement of the lever element 120 (and the lever recess 125) causes one or more of the sidewalls of the lever recess 125 to contact one or more of the sidewalls of the latch protrusion 135 and urged the latch protrusion 135 (and the latch element 130) to move laterally, away from the charging handle body 102.

If included, the spring biasing element 150 interacts between an interior side wall of the charging handle body 102 and the lever element 120 to bias the lever element 120 in a forward or locked position. As the lever element 120 is urged rearward, from either the right handle portion 105 or the left handle portion 106 of the charging handle body 102, the spring bias of the spring biasing element 150 can be overcome to move the latch element 130 from the locked to unlocked position.

In various exemplary embodiments, a spring biasing element 150 comprises a curved portion of spring steel. In certain other exemplary, nonlimiting embodiments, the spring biasing element 150' comprises one or more compression springs. It should also be understood that the spring biasing element 150 and/or 150' may optionally comprise a spring, a resilient portion of material, or other element capable of providing a biasing force to the lever element 120.

Figure 20:
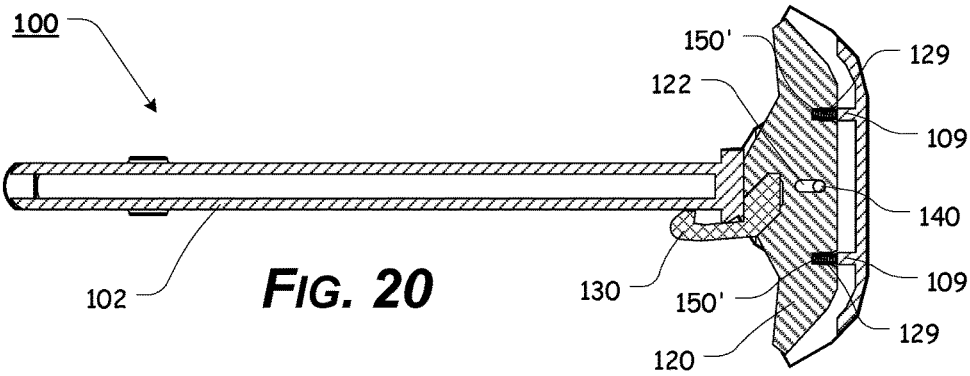
FIG. 20 illustrates a top, cross-sectional view showing various components of an exemplary embodiment of an ambidextrous charging handle, wherein the latch element is in the locked position, according to an exemplary embodiment of the present disclosure.

In various exemplary, nonlimiting embodiments, as illustrated in FIG. 20, one or more alignment protrusions 109 extend within various portions of the handle recess 104 and correspond to mating alignment recesses 129 formed in the lever element 120. If included, the one or more alignment protrusions 109 are aligned with or within the alignment recesses 129 during movement of the lever element 120 along the longitudinal axis of the charging handle 100. It should also be appreciated that the protrusions may extend from the lever element 120 and interact with mating recesses formed in the handle recess 104.

In various exemplary embodiments, a spring biasing element 150 or 150' is positioned within each of the mating alignment recess 129 to provide spring biasing to the lever element 120.

Figure 21:
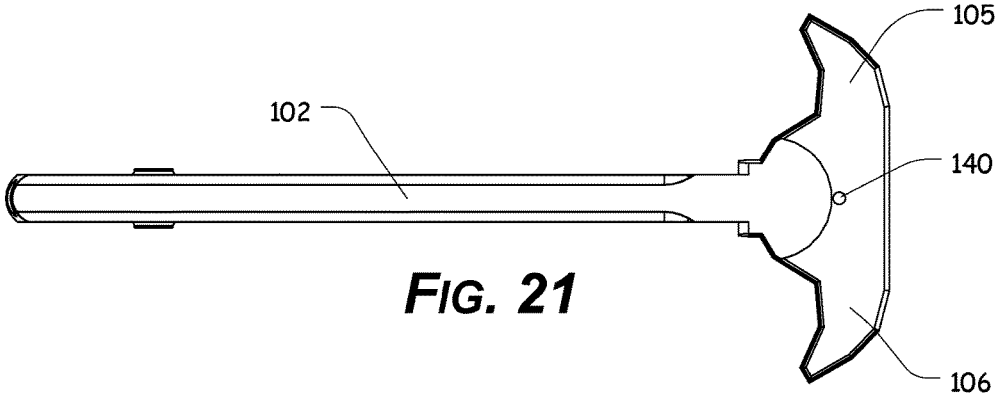
FIG. 21 illustrates a top view of an exemplary embodiment of an ambidextrous charging handle body, wherein the latch element is in the locked position, according to an exemplary embodiment of the present disclosure.
Figure 22:
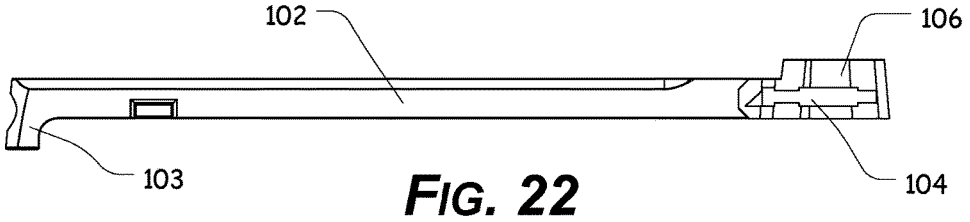
FIG. 22 illustrates a side view of an exemplary embodiment of an ambidextrous charging handle body, wherein the latch element is in the locked position, according to an exemplary embodiment of the present disclosure.
Figure 23:
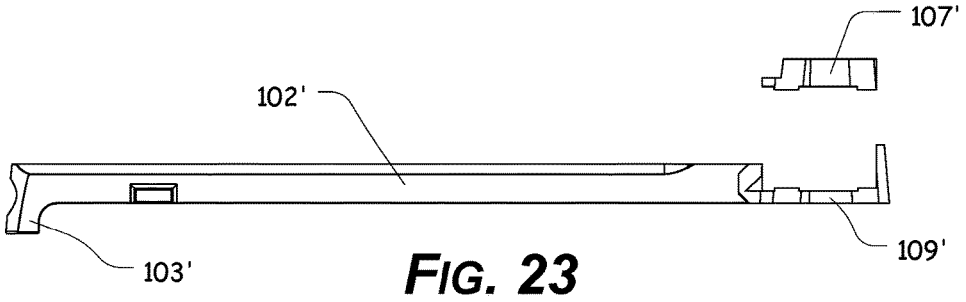
FIG. 23 illustrates a side view of an exemplary embodiment of an ambidextrous charging handle body, wherein the latch element is in the locked position, according to an exemplary embodiment of the present disclosure.
Figure 24:
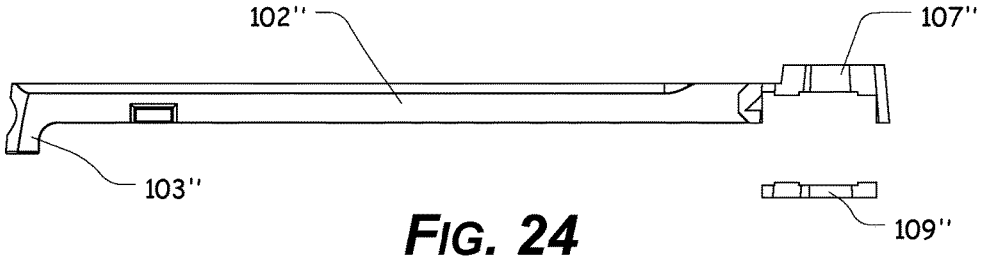
FIG. 24 illustrates a side view of an exemplary embodiment of an ambidextrous charging handle body, wherein the latch element is in the locked position, according to an exemplary embodiment of the present disclosure.
Figure 25:
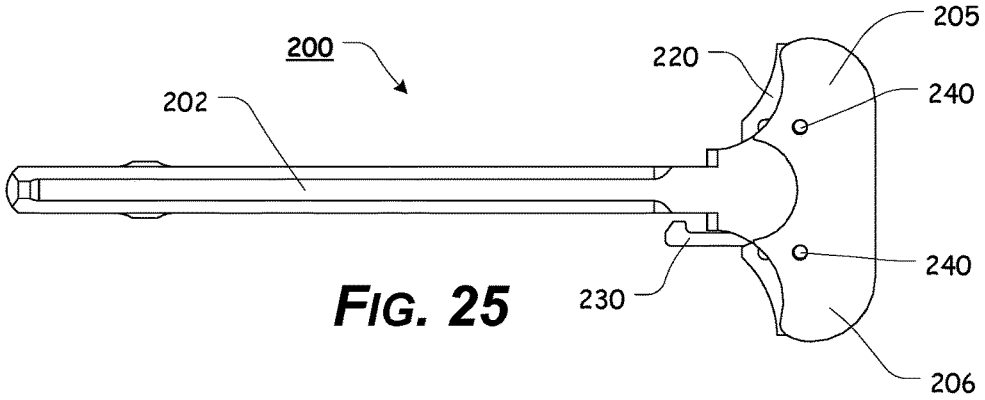
FIG. 25 illustrates a top view of an exemplary embodiment of an ambidextrous charging handle, wherein the latch element is in the locked position, according to an exemplary embodiment of the present disclosure.
Figure 26:
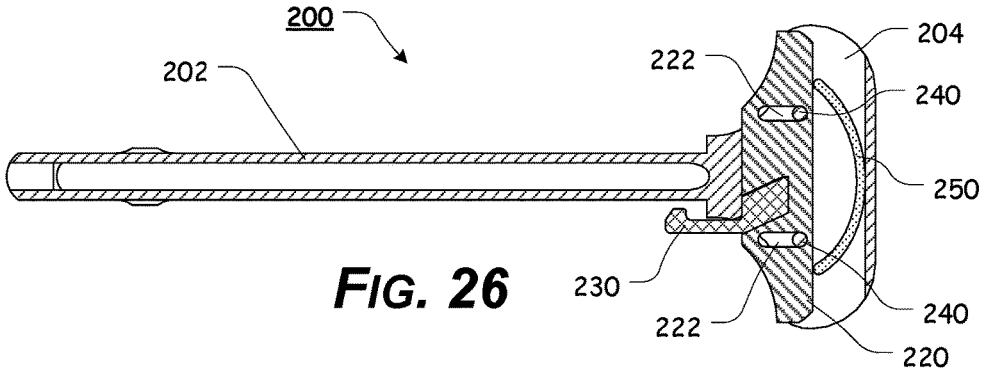
FIG. 26 illustrates a top, cross-sectional view of an exemplary embodiment of an ambidextrous charging handle, wherein the latch element is in the locked position, according to an exemplary embodiment of the present disclosure.
Figure 27:
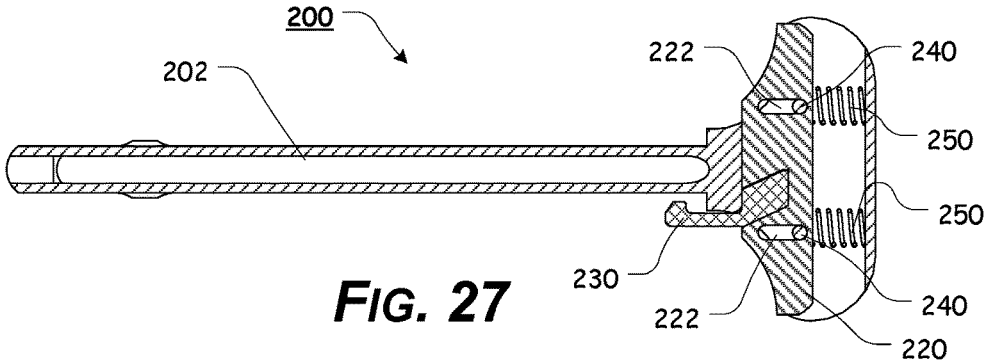
FIG. 27 illustrates a top, cross-sectional view of an exemplary embodiment of an ambidextrous charging handle, wherein the latch element is in the locked position, according to an exemplary embodiment of the present disclosure.
Figure 28:
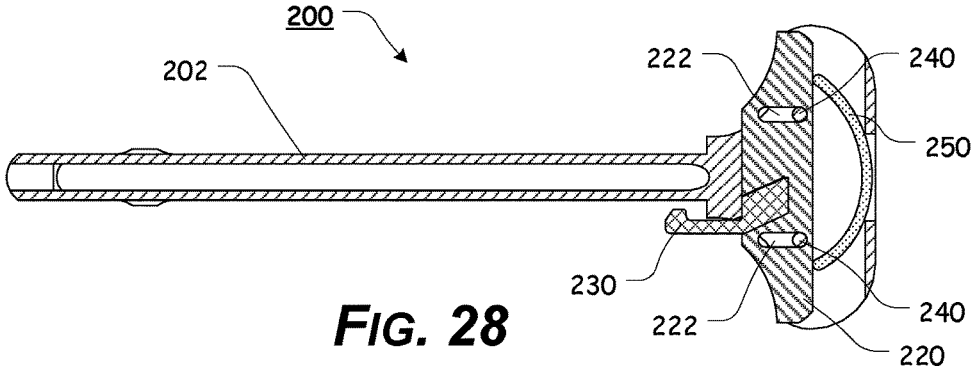
FIG. 28 illustrates a top, cross-sectional view of an exemplary embodiment of an ambidextrous charging handle, wherein the latch element is in the locked position, according to an exemplary embodiment of the present disclosure.
Figure 29:
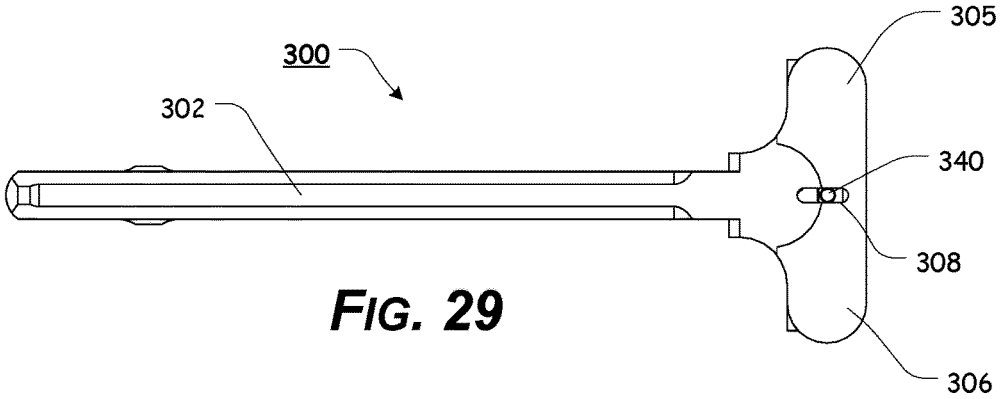
FIG. 29 illustrates a top view of an exemplary embodiment of an ambidextrous charging handle, wherein the latch element is in the locked position, according to an exemplary embodiment of the present disclosure.
Figure 30:
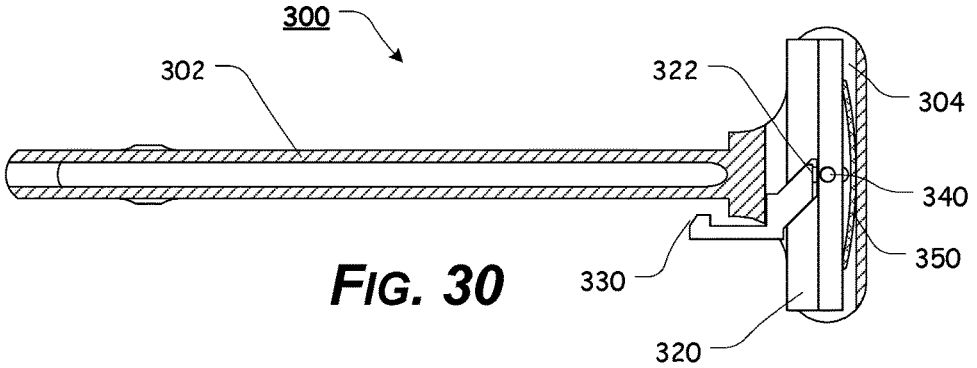
FIG. 30 illustrates a top, cross-sectional view of an exemplary embodiment of an ambidextrous charging handle, wherein the latch element is in the locked position, according to an exemplary embodiment of the present disclosure.
Figure 31:
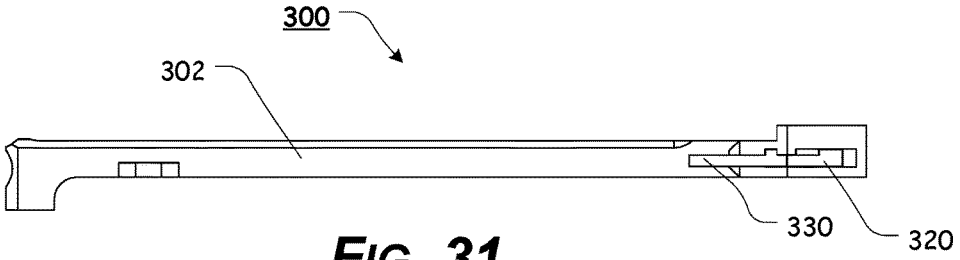
FIG. 31 illustrates a side view of an exemplary embodiment of an ambidextrous charging handle, wherein the latch element is in the locked position, according to an exemplary embodiment of the present disclosure.
Figure 32:
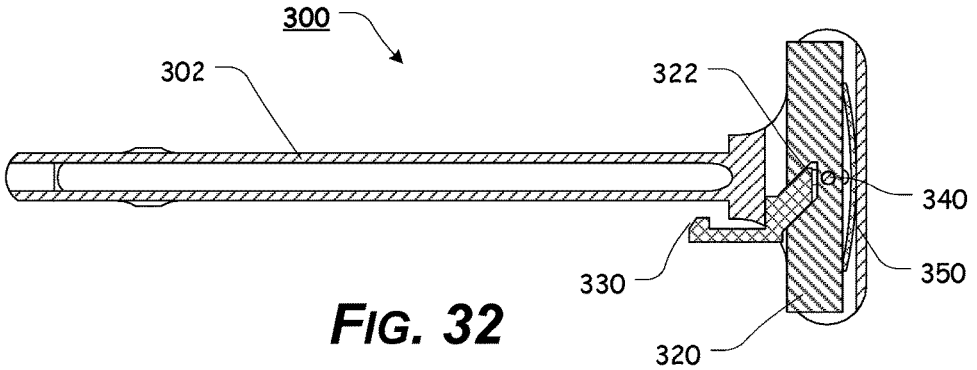
FIG. 32 illustrates a top, cross-sectional view of an exemplary embodiment of an ambidextrous charging handle, wherein the latch element is in the locked position, according to an exemplary embodiment of the present disclosure.

In certain exemplary embodiments, as illustrated in FIGS. 21-22, the charging handle body 102 may be formed as an integral unit. As illustrated in FIG. 23, the charging handle body 102' may be formed of at least two portions of material. A lower handle portion 109' that includes the bolt engagement element 103' is attached or coupled to an upper handle portion 107' to form the charging handle body 102'. Alternatively, as illustrated in FIG. 24, the charging handle body 102" may be formed of at least two portions of material, wherein an upper handle portion 107" that includes the bolt engagement element 103" is attached or coupled to a lower handle portion 109" to form the charging handle body 102". Suitable materials can be used and sections or elements made independently and attached or coupled together, such as by adhesives, welding, screws, rivets, pins, or other fasteners, to form the various elements of the ambidextrous charging handle body 102, 102', and/or 102".

In various exemplary embodiments, various components of the ambidextrous charging handle 100 are substantially rigid and are formed of aluminum. Alternate materials of construction of the various components of the ambidextrous charging handle 100 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the ambidextrous charging handle 100 is a design choice based on the desired appearance and functionality of the ambidextrous charging handle 100.

It should also be understood that the overall size and shape of the ambidextrous charging handle 100 and the various portions thereof is a design choice based upon the desired functionality and/or appearance of the ambidextrous charging handle 100.

FIGS. 25-28 illustrate various elements and/or aspects of an exemplary embodiment of the ambidextrous charging handle 200, of the present disclosure. As shown in FIGS. 25-28, the ambidextrous charging handle 200 comprises at least some of a charging handle body 202, a handle recess 204, a right handle portion 205, a left handle portion 206, a lever element 220, a latch element 230, and two spring biasing elements 250. It should be appreciated that each of these elements (as well as other, similarly named elements of the ambidextrous charging handle 200) correspond to and operate similarly to similarly named elements, as described herein with reference to the ambidextrous charging handle 100 of FIGS. 1-24. Thus, it should be appreciated that the ambidextrous charging handle 200 may incorporate one or any of the features are elements of the ambidextrous charging handle 100 of FIGS. 1-24.

However, as shown in FIGS. 25-28, two elongate lever channels 222 are formed through the lever element 220 (as opposed to the single elongate lever channel 122 formed through the lever element 120). Similarly, two slide protrusions or slide pins 240 (as opposed to a single slide protrusion or slide pin 140) enable the lever element 220 to be slidable forward and/or rearward, relative to the longitudinal axis of the charging handle 200, within the handle recess 204.

FIGS. 29-32 illustrate various elements and/or aspects of an exemplary embodiment of the ambidextrous charging handle 300, of the present disclosure. As shown in FIGS. 29-32, the ambidextrous charging handle 300 comprises at least some of a charging handle body 302, a handle recess 304, a right handle portion 305, a left handle portion 306, a lever element 320, an elongate lever channel 322, a latch element 330, a slide protrusion or slide pin 340, and a spring biasing element 350. It should be appreciated that each of these elements (as well as other, similarly named elements of the ambidextrous charging handle 300) correspond to and operate similarly to similarly named elements, as described herein with reference to the ambidextrous charging handle 100 of FIGS. 1-24. Thus, it should be appreciated that the ambidextrous charging handle 300 may incorporate one or any of the features are elements of the ambidextrous charging handle 100 of FIGS. 1-24.

However, as shown in FIGS. 29-32, the slide protrusion or slide pin 340 interacts with an elongate handle channel 308 formed in one or both of the bottom wall of the handle recess 304 and/or the top wall of the handle recess 304.

FIGS. 33-34 illustrate various elements and/or aspects of an exemplary embodiment of the ambidextrous charging handle 400, of the present disclosure. As shown in FIGS. 33-34, the ambidextrous charging handle 400 comprises at least some of a charging handle body 402, a handle recess 404, a right handle portion 405, a left handle portion 406, a lever element 420, an elongate lever channel 422, a latch element 440, and a spring biasing element 450. It should be appreciated that each of these elements (as well as other, similarly named elements of the ambidextrous charging handle 400) correspond to and operate similarly to similarly named elements, as described herein with reference to the ambidextrous charging handle 100 of FIGS. 1-24. Thus, it should be appreciated that the ambidextrous charging handle 400 may incorporate one or any of the features are elements of the ambidextrous charging handle 100 of FIGS. 1-24.

However, as shown in FIGS. 33-34, two elongate handle channels 408 are formed through the charging handle body 402 (as opposed to the single elongate lever channel 308 formed through the charging handle body 302). Similarly, two slide protrusions or slide pins 440 (as opposed to a single slide protrusion or slide pin 340) enable the lever element 420 to be slidable forward and/or rearward, relative to the longitudinal axis of the charging handle body 402, within the handle recess 404.

FIGS. 35-51 illustrate various elements and/or aspects of an exemplary embodiment of the ambidextrous charging handle 500, of the present disclosure. As shown in FIGS. 35-51, the ambidextrous charging handle 500 comprises at least some of a charging handle body 502, a handle recess 504, a right handle portion 505, a left handle portion 506, one or more slide support surfaces 507, two slide pin apertures 508, a lever element 520, two elongate lever channels 522, a lever recess 525, a latch element 530, a claw 532, a ramp surface 533, a shoulder 534, a latch protrusion 535, two slide protrusions or slide pins 540, and two spring biasing elements 550. It should be appreciated that each of these elements (as well as other, similarly named elements of the ambidextrous charging handle 500) correspond to and operate similarly to similarly named elements, as described herein with reference to the ambidextrous charging handles 100, 200, 300, and/or 400. Thus, it should be appreciated that the ambidextrous charging handle 500 may incorporate one or any of the features are elements of the ambidextrous charging handles disclosed herein.

Figure 50:
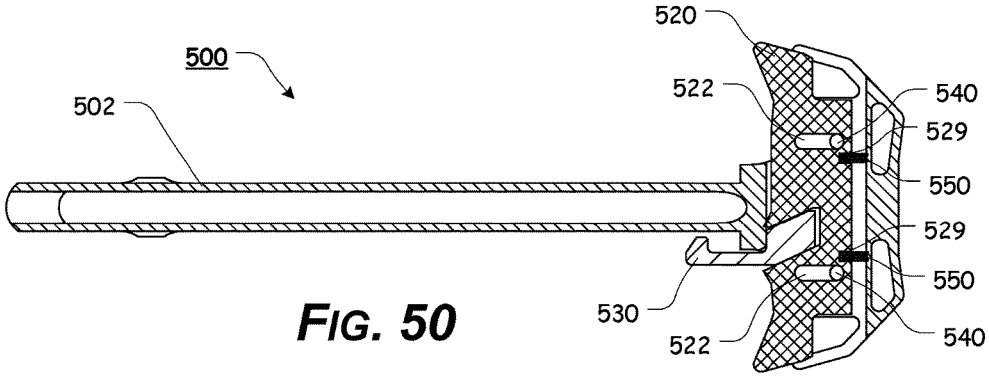
FIG. 50 illustrates a top, cross-sectional view showing various components of an exemplary embodiment of an ambidextrous charging handle, wherein the latch element is in the locked position, according to an exemplary embodiment of the present disclosure.
Figure 51:
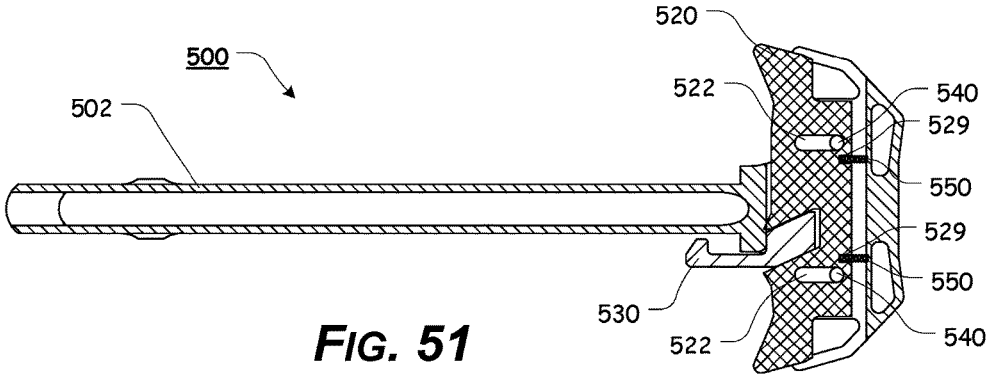
FIG. 51 illustrates a top, cross-sectional view showing various components of an exemplary embodiment of an ambidextrous charging handle, wherein the latch element is in the locked position, according to an exemplary embodiment of the present disclosure.

Additionally, two spring biasing element recesses 529, are formed within a rear portion of the lever element 520 and are sized and shaped so as to receive at least a portion of a spring biasing element 550 therein. The spring biasing elements 550 extend from the spring biasing element recesses 529 so as to contact a wall or other surface defining a portion of the handle recess 504 so as to provide a spring biasing force to the lever element 520, biasing the lever element 520 toward a closed or locked position, as illustrated in FIG. 50.

Figure 52:
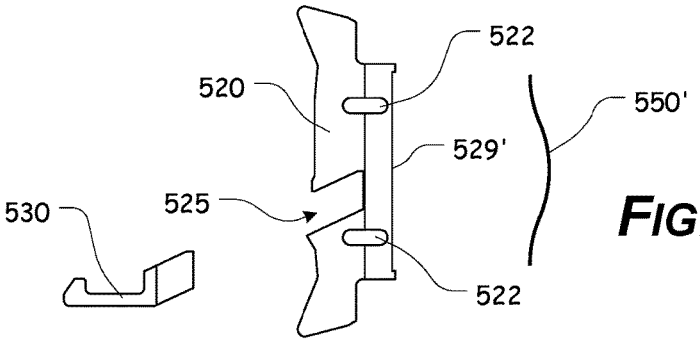
FIG. 52 illustrates a top view of an exemplary embodiment of the lever element, the latch element, and the spring biasing element of an ambidextrous charging handle, according to an exemplary embodiment of the present disclosure.
Figure 53:
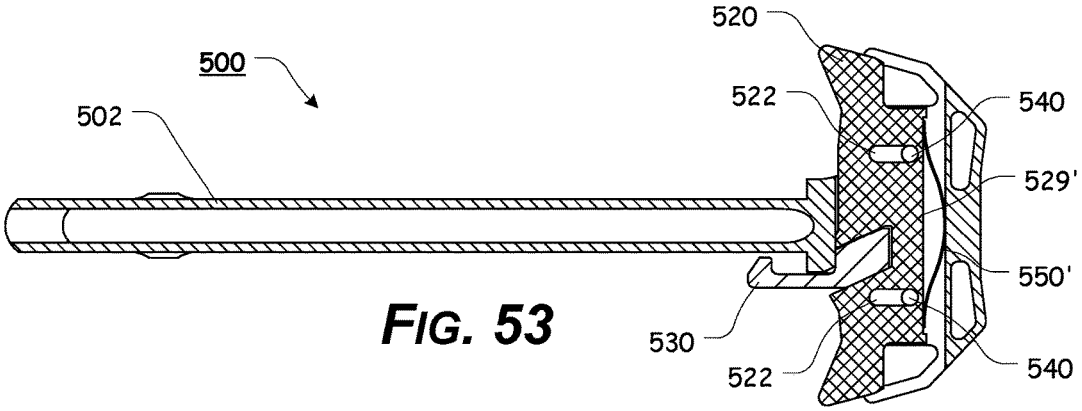
FIG. 53 illustrates a top, cross-sectional view showing various components of an exemplary embodiment of an ambidextrous charging handle, wherein the latch element is in the locked position, according to an exemplary embodiment of the present disclosure.
Figure 54:
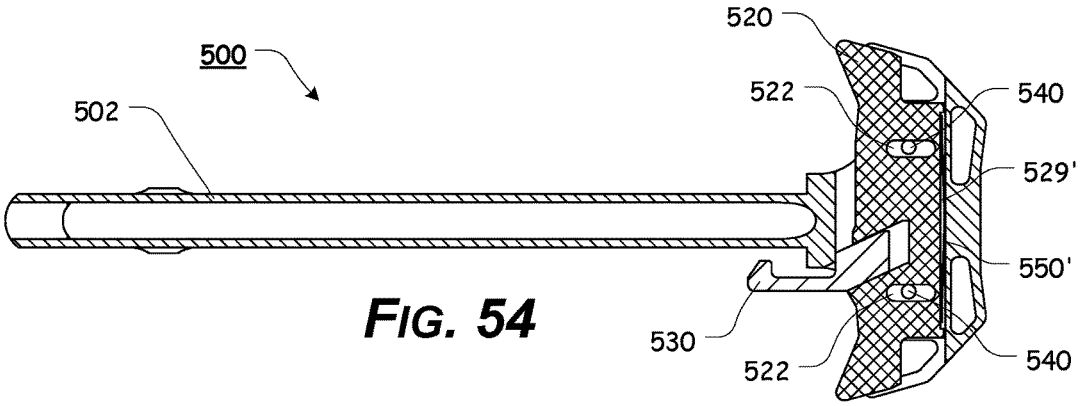
FIG. 54 illustrates a top, cross-sectional view showing various components of an exemplary embodiment of an ambidextrous charging handle, wherein the latch element is in the locked position, according to an exemplary embodiment of the present disclosure.
Figure 55:
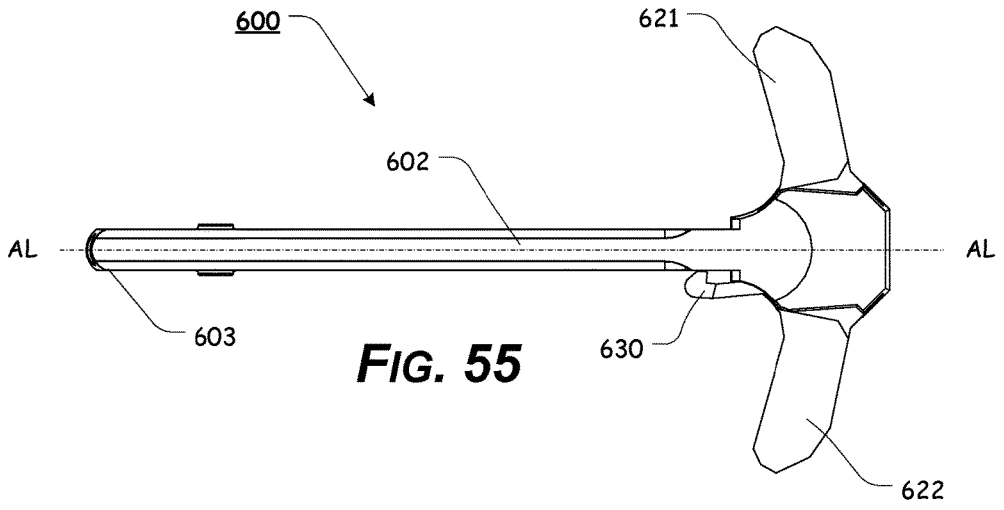
FIG. 55 illustrates a top view of an exemplary embodiment of an ambidextrous charging handle, according to an exemplary embodiment of the present disclosure.
Figure 56:
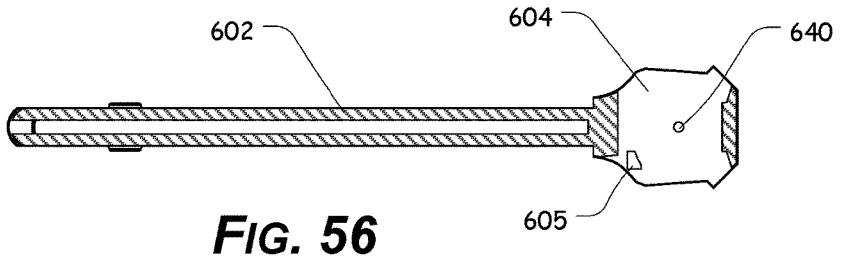
FIG. 56 illustrates a top, cross-sectional view of an exemplary embodiment of the charging handle body, according to an exemplary embodiment of the present disclosure.
Figure 57:
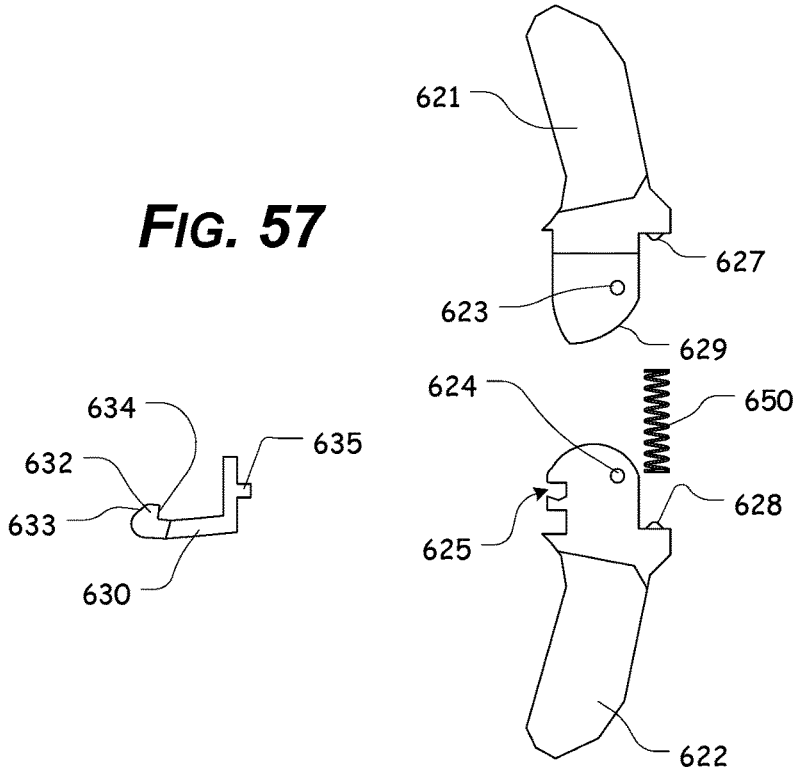
FIG. 57 illustrates an exploded, top view of an exemplary embodiment of the first lever element, the second lever element, the latch element, and the spring biasing element of an ambidextrous charging handle, according to an exemplary embodiment of the present disclosure.
Figure 58:
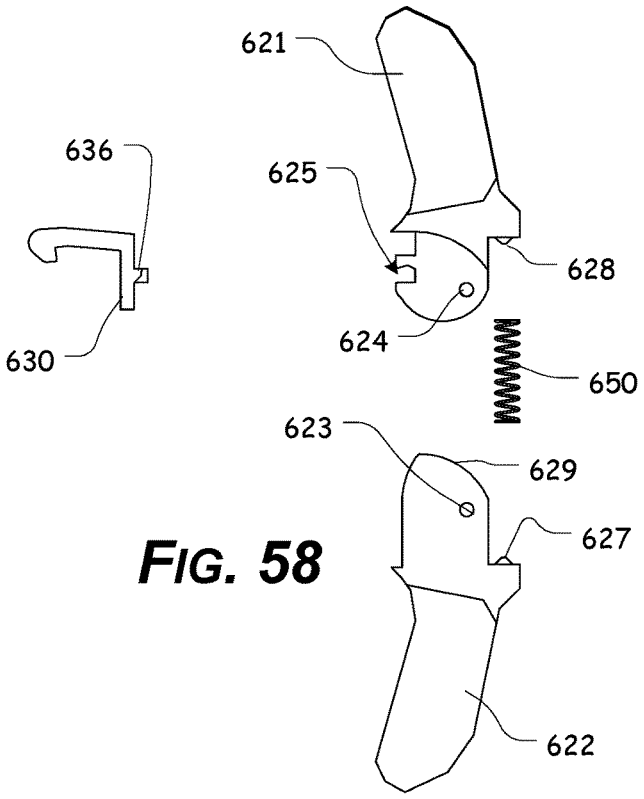
FIG. 58 illustrates an exploded, bottom view of an exemplary embodiment of the first lever element, the second lever element, the latch element, and the spring biasing element of an ambidextrous charging handle, according to an exemplary embodiment of the present disclosure.
Figure 59:
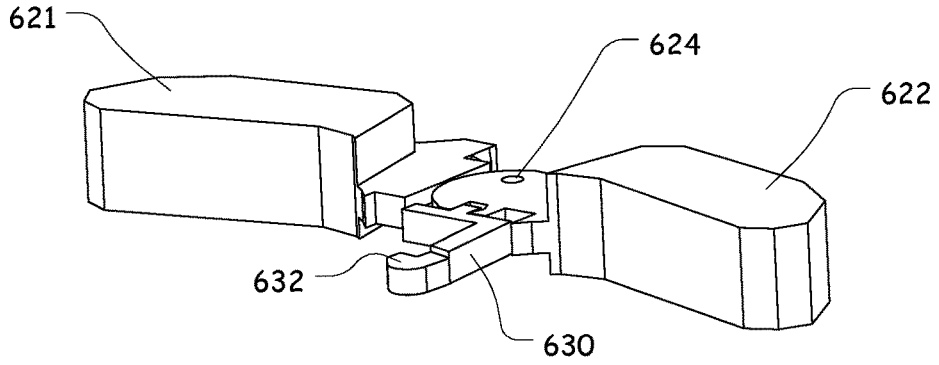
FIG. 59 illustrates upper, front, perspective view of an exemplary embodiment of the first lever element, the second lever element, the latch element, and the spring biasing element of an ambidextrous charging handle, according to an exemplary embodiment of the present disclosure.
Figure 60:
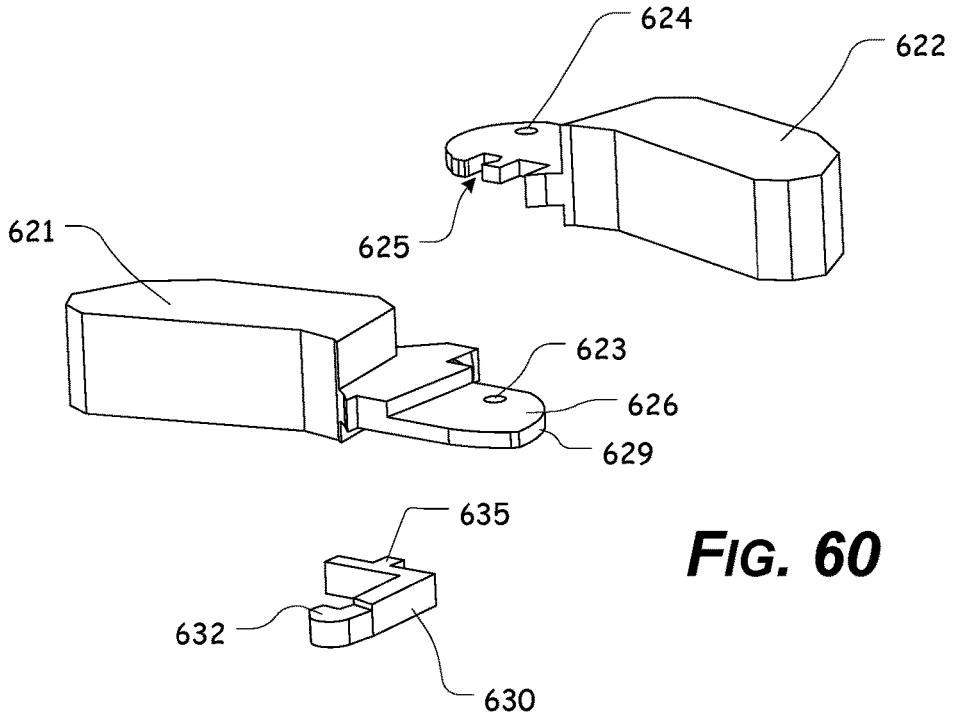
FIG. 60 illustrates an upper, front, exploded, perspective view of an exemplary embodiment of the first lever element, the second lever element, the latch element, and the spring biasing element of an ambidextrous charging handle, according to an exemplary embodiment of the present disclosure.
Figure 61:
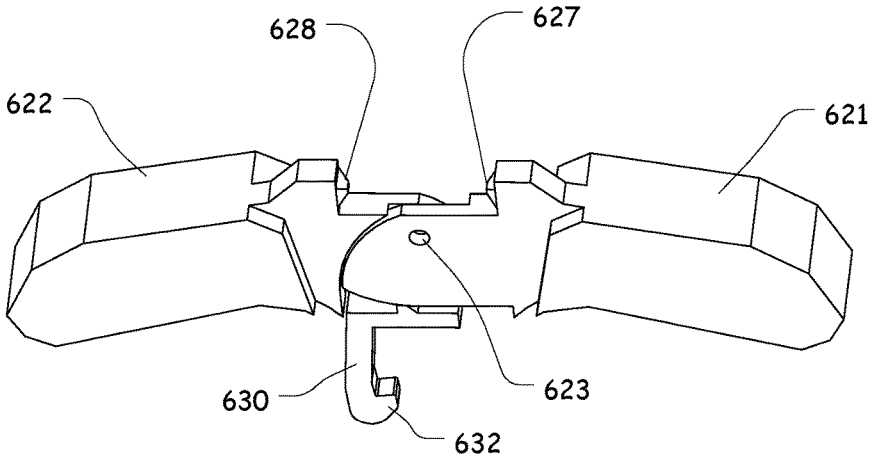
FIG. 61 illustrates lower, rear, perspective view of an exemplary embodiment of the first lever element, the second lever element, the latch element, and the spring biasing element of an ambidextrous charging handle, according to an exemplary embodiment of the present disclosure.
Figure 62:
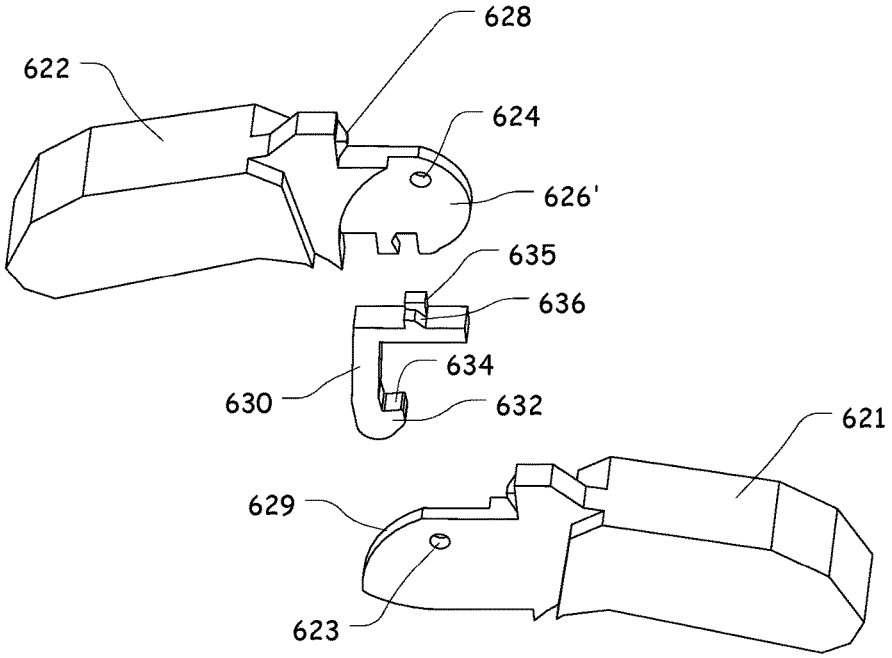
FIG. 62 illustrates lower, rear, exploded, perspective view of an exemplary embodiment of the first lever element, the second lever element, the latch element, and the spring biasing element of an ambidextrous charging handle, according to an exemplary embodiment of the present disclosure.
Figure 63:
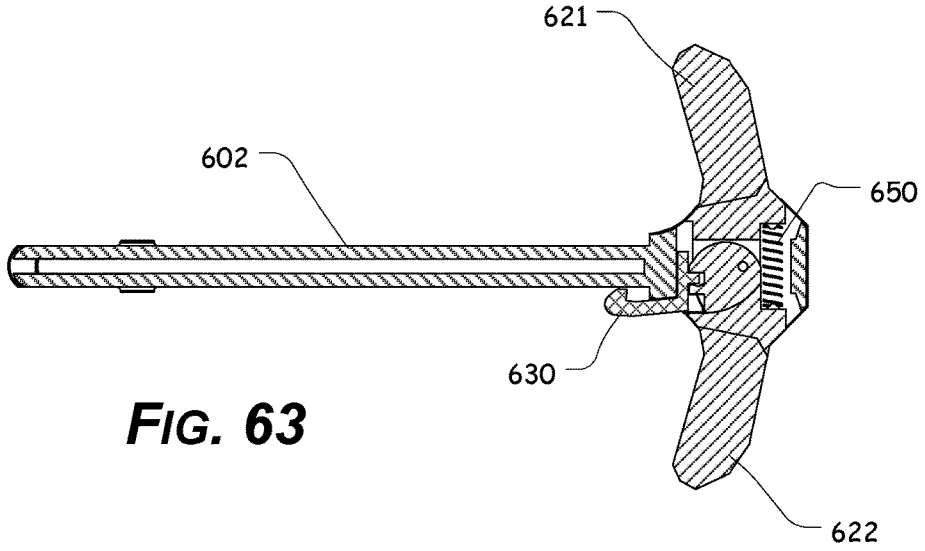
FIG. 63 illustrates a top, cross-sectional view showing various components of an exemplary embodiment of an ambidextrous charging handle, wherein the latch element is in the locked position, according to an exemplary embodiment of the present disclosure.
Figure 64:
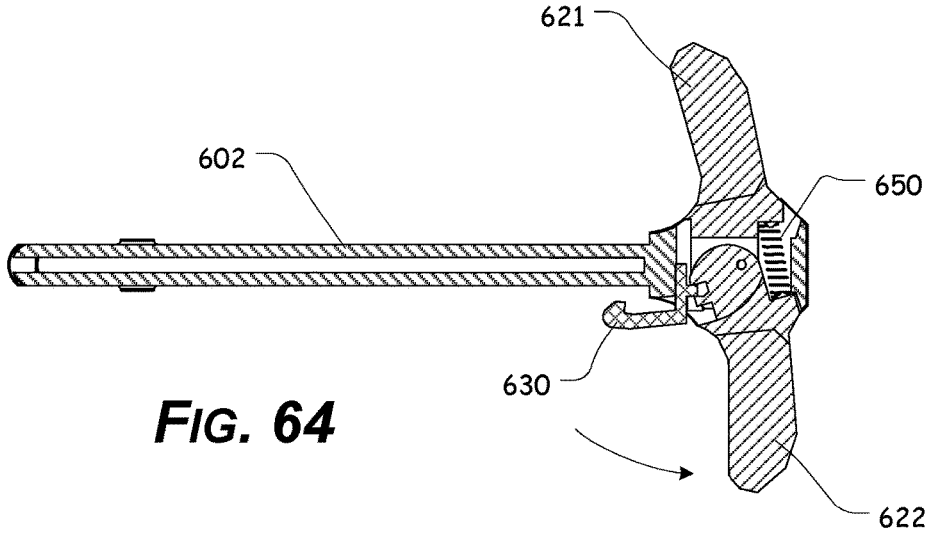
FIG. 64 illustrates a top, cross-sectional view showing various components of an exemplary embodiment of an ambidextrous charging handle, wherein the second lever element is rotated rearward and the latch element is in the unlocked position, according to an exemplary embodiment of the present disclosure.
Figure 65:
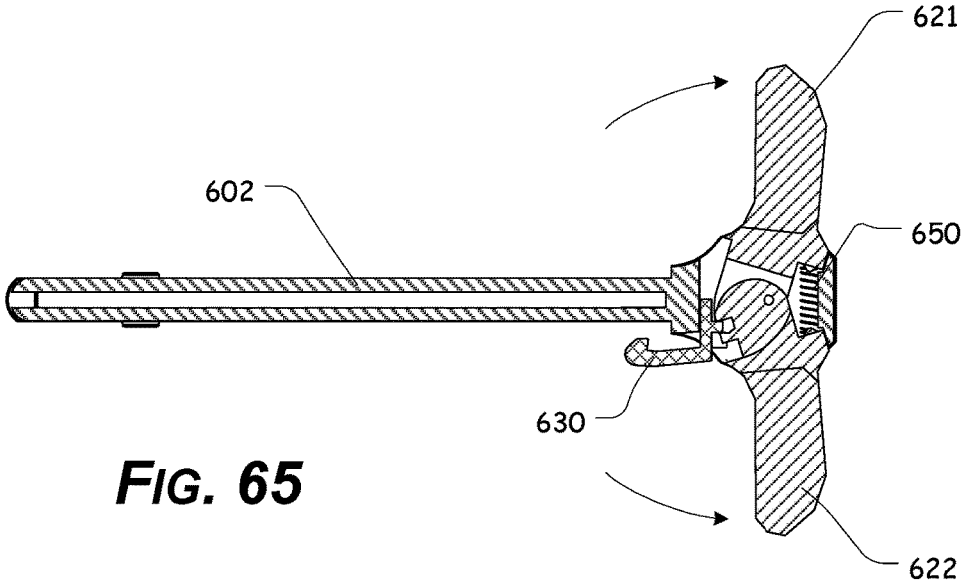
FIG. 65 illustrates a top, cross-sectional view showing various components of an exemplary embodiment of an ambidextrous charging handle, wherein the first lever element is rotated rearward and the latch element is in the unlocked position, according to an exemplary embodiment of the present disclosure.
Figure 66:
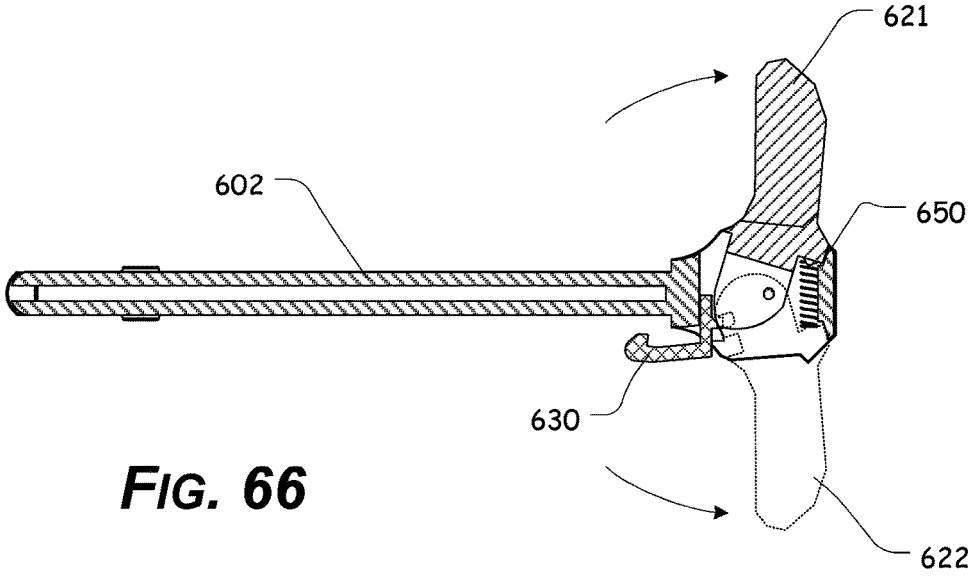
FIG. 66 illustrates a top, cross-sectional view showing various components of an exemplary embodiment of an ambidextrous charging handle, wherein the first lever element is rotated rearward, the latch element is in the unlocked position, and the second lever element is shown in broken lines to further illustrate the interaction of the first lever element and the latch element, according to an exemplary embodiment of the present disclosure.
Figure 67:
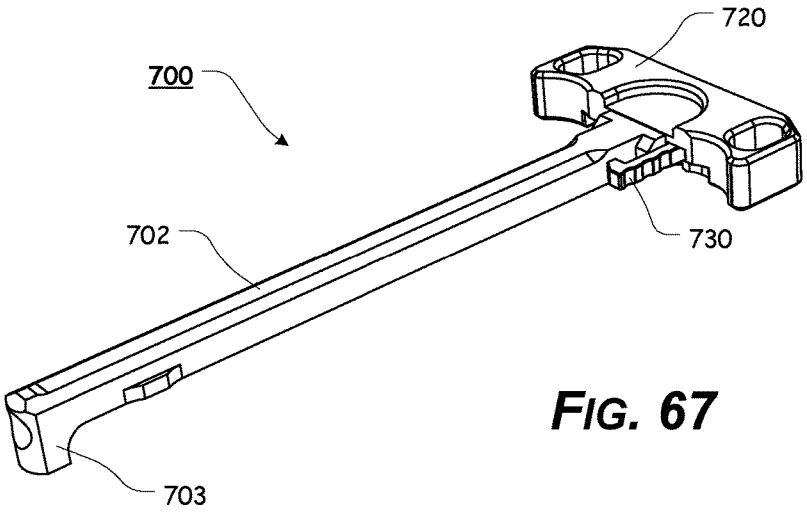
FIG. 67 illustrates an upper, front, left, perspective view showing various components of an exemplary embodiment of an ambidextrous charging handle, according to an exemplary embodiment of the present disclosure.
Figure 68:
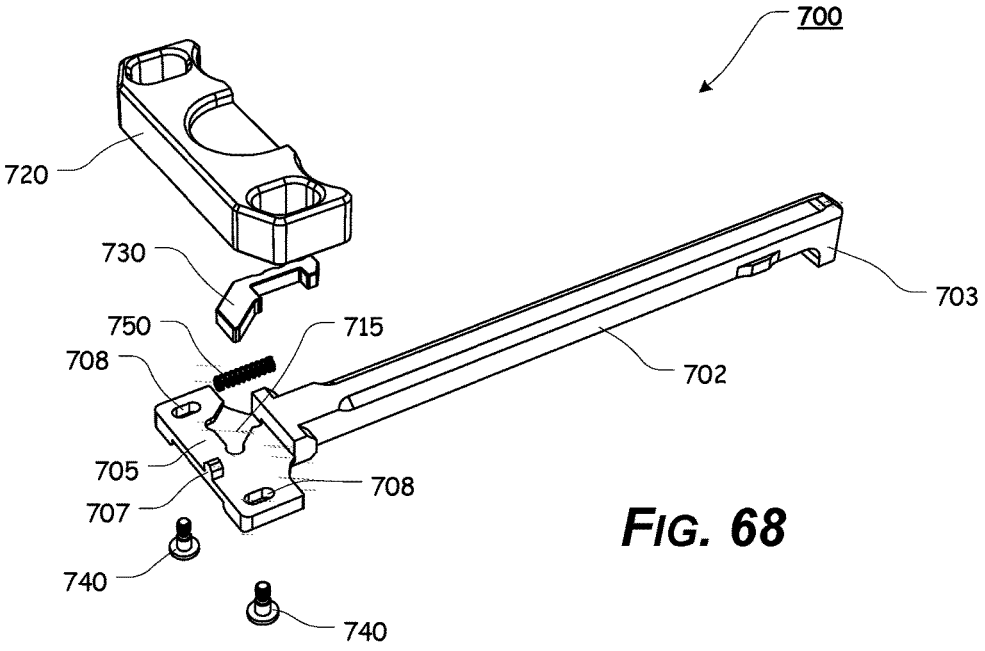
FIG. 68 illustrates an upper, rear, right, exploded view showing various components of an exemplary embodiment of an ambidextrous charging handle, according to an exemplary embodiment of the present disclosure.
Figure 69:
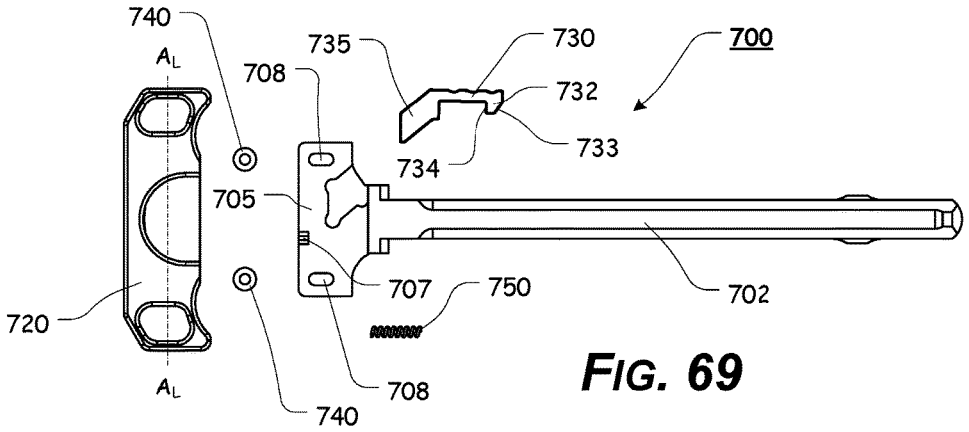
FIG. 69 illustrates a top, exploded view showing various components of an exemplary embodiment of an ambidextrous charging handle, according to an exemplary embodiment of the present disclosure.
Figure 70:
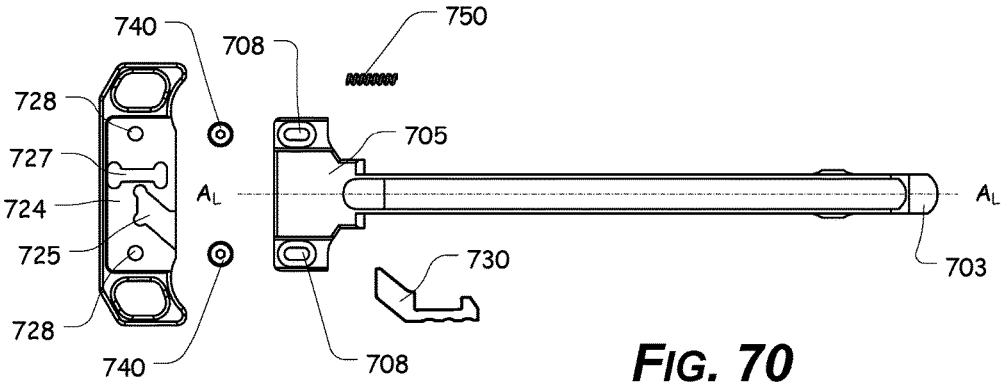
FIG. 70 illustrates a bottom, exploded view showing various components of an exemplary embodiment of an ambidextrous charging handle, according to an exemplary embodiment of the present disclosure.
Figure 71:
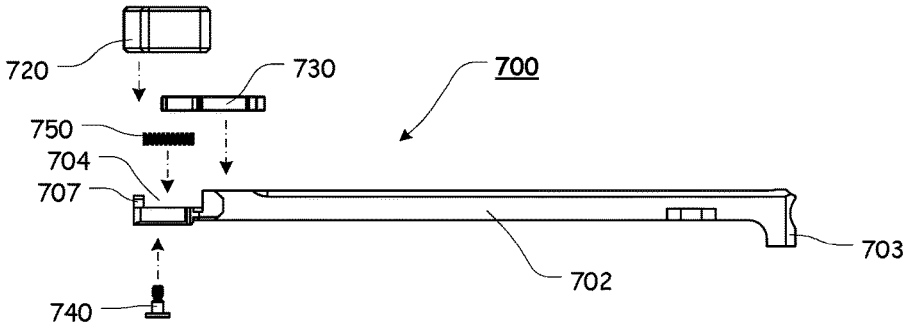
FIG. 71 illustrates a right side, exploded view showing various components of an exemplary embodiment of an ambidextrous charging handle, according to an exemplary embodiment of the present disclosure.

In certain exemplary embodiments, as illustrated in FIGS. 52-54 illustrate, the spring biasing element recesses 529 are replaced by an elongate spring biasing element channel recess 529' and the coil spring type spring biasing elements 550 are replaced by a curved portion of spring steel or other resilient or biasing element to form a spring biasing element 550'. The elongate spring biasing element channel recess 529' provides a space or area of the lever element 520 formed so as to receive at least a portion of the spring biasing element 550' therein and maintain the relative position of the spring biasing element 550' relative to the lever element 520.

The spring biasing element 550 interacts between an interior side wall of the charging handle body 502 and the lever element 520 to bias the lever element 520 in a forward or locked position. As the lever element 520 is urged rearward, the spring bias of the spring biasing element 550 can be overcome to move the latch element 530 from a locked position, as illustrated in FIG. 53 to an unlocked position, as illustrated in FIG. 54.

FIGS. 55-66 illustrate an exemplary, nonlimiting embodiment of the ambidextrous charging handle 600, according to this disclosure. As illustrated, the exemplary embodiment of the ambidextrous charging handle 600 comprises a charging handle body 602, a latch element 630, a first lever element 621, a second lever element 622, and a spring biasing element 650.

The charging handle body 602 comprises an elongate portion of material that extends along a longitudinal axis from a rear handle portion to a forward end having a bolt engagement element 603. The rear handle portion includes a handle recess 604 formed so as to pivotably receive at least a portion of the latch element 630, the first lever element 621, the second lever element 622, and the spring biasing element 650. The handle recess 604 includes a slide protrusion or slide pin 640 extending from a bottom wall of the handle recess 604. Additionally, a camming element 605 extends from the bottom wall of the handle recess 604.

The latch element 630 extends from a first portion to a second portion and a claw 632 (including a ramp surface 633 and shoulder 634) is formed proximate the first portion of the latch element 630. A primary latch protrusion 635 is formed proximate the second portion of the latch element 630, in a top portion of the latch element 630, while a secondary latch protrusion 636 is formed proximate the second portion of the latch element 630, in a bottom portion of the latch element 630.

The first lever element 621 comprises an elongate portion of material that extends from a latch engagement portion to a finger engagement portion. A pivot aperture 623 is formed through the latch engagement portion, such that when the pivot aperture 623 interacts with the pivot protrusion, the first lever element 621 is able to be pivoted from a locked position to an unlocked position. The first lever element 621 includes a curved, camming surface 629 formed so as to interact with a secondary latch protrusion 636 of the latch element 630. A spring engagement protrusion 627 extends from a portion of the first lever element 621 so as to engage and interact with the spring biasing element 650.

The second lever element 622 comprises an elongate portion of material that also extends from a latch engagement portion to a finger engagement portion. A pivot aperture 624 is formed through the latch engagement portion, such that when the pivot aperture 624 interacts with the pivot protrusion, the second lever element 622 is able to be pivoted from a locked position to an unlocked position. The second lever element 622 includes a lever recess 625 formed so as to interact with a primary latch protrusion 635 of the latch element 630. A spring engagement protrusion 628 extends from a portion of the second lever element 622 so as to engage and interact with the spring biasing element 650.

The first lever element 621 and the second lever element 622 each include recessed surface areas 626 and 626', respectively, within their respective latch engagement portions such that portions of the first lever element 621 and the second lever element 622 are able to overlap one another. By providing overlapping portions, the lever recess 625 and the camming surface 629 are able to more easily interact with the primary latch protrusion 635 and the secondary latch protrusion 636, respectively.

The primary latch protrusion 635 is formed so as to interact with the lever recess 625 of the second lever element 622 such that rotation of the second lever element 622 about the pivot protrusion produces lateral movement of the latch element 630 relative to the longitudinal axis of the charging handle 600.

The secondary latch protrusion 636 is formed so as to interact with the camming surface 629 of the first lever element 621 such that rotation of the first lever element 621 about the pivot protrusion also produces lateral movement of the latch element 630 relative to the longitudinal axis of the charging handle 600. When the camming surface 629 of the first lever element 621 produces movement of the latch element 630 (via interaction of the secondary latch protrusion 636 and the camming surface 629) the primary latch protrusion 635 interacts with the lever recess 625 of the second lever element 622 to produce rotational movement of the second lever element 622.

The spring biasing element 650 interacts between the spring engagement protrusion 627 of the first lever element 621 and the spring engagement protrusion 628 of the second lever element 622 to bias the first lever element 621 and the second lever element 622 against one another in a forward or locked position. As the first lever element 621 and/or the second lever element 622 is urged rearward, the spring bias of the spring biasing element 650 can be overcome to move the latch from the locked to unlocked position.

In various exemplary embodiments, a spring biasing element 650 comprises a spring. However, it should be appreciated that the spring biasing element 650 may comprise a spring, a resilient portion of material, or other element capable of providing a biasing force to the first lever element 621 and/or the second lever element 622.

FIGS. 67-75 illustrate an exemplary, nonlimiting embodiment of the ambidextrous charging handle 700, according to this disclosure. As illustrated, the exemplary embodiment of the ambidextrous charging handle 700 comprises a charging handle body 702, a latch element 730, a handle element 720, and a spring biasing element 750.

The charging handle body 702 comprises an elongate portion of material that extends along a longitudinal axis from a base portion 705 to a forward end having a bolt engagement element 703.

The base portion 705 includes a body recess 715 formed within the base portion 705 portion, which is shaped so as to slidably receive at least a portion of the latch element 730 within at least a portion of the body recess 715. An abutment protrusion 707 extends from a surface of the base portion 705, so as to provide an abutment surface for the spring biasing element 750. In various exemplary, nonlimiting embodiments, the base portion 705 is a substantially T-shaped base portion 705.

Two elongate apertures 708 are formed through a portion of the base portion 705 and are formed so as to have substantially parallel longitudinal axes. Each elongate aperture 708 is formed so as to slidably receive at least a portion of a shoulder bolt 740 therethrough.

In various exemplary embodiments, the handle element 720 comprises an elongate portion of material that includes a handle recess 724 formed within a portion of the handle 720. The handle recess 724 is formed so as to slidably receive at least a portion of the base portion 705 of the charging handle body 702 therein. A lever recess 725 is formed within the handle recess 724. The lever recess 725 is shaped so as to slidably receive at least a portion of the latch element 730 within at least a portion of the lever recess 725. In various exemplary embodiments, the lever recess 725 is formed at an obtuse or an acute angle, θ, relative to a longitudinal axis of the handle element 720.

An elongate spring recess 727 is also formed within the handle recess 724 of the lever recess 725. The spring recess 727 is generally formed perpendicular to a longitudinal axis of the handle element 720 and is formed so as to allow at least a portion of the abutment protrusion 707 to be positioned within the spring recess 727, while allowing the spring biasing element 750 to also be positioned within the spring recess 727.

Two threaded recesses 728 are formed in or through the handle element 720. Each of the threaded recesses 728 is formed at a location that corresponds to an elongate aperture 708. The threaded recesses 728 are formed and positioned so as to allow at least a portion of the threaded portion of each shoulder bolt 740 to be positioned through each elongate aperture and threadedly attached to the handle element 720, via interaction between the external threads of the shoulder bolt 740 and the internal threads of the threaded recesses 728. Once appropriately attached, a smooth portion of each shoulder bolt 740 is positioned within each elongate aperture 708 to allow the handle element 720 to be repeatably slidable relative to the base portion 705 of the charging handle body 702.

The latch element 730 extends from a first portion to a second portion and a claw 732 (including a ramp surface 733 and shoulder 734) is formed proximate the first portion of the latch element 730. A latch protrusion 735 is formed proximate the second portion of the latch element 730. The latch protrusion 735 is formed so as to be at least partially received within and interact with the body recess 715 and the lever recess 725 such that movement of the handle element 720 along the longitudinal axis of the charging handle 700 (forward and backward) produces lateral (side-to-side), non-pivoting, movement of the latch element 730 relative to the longitudinal axis of the charging handle 700.

During assembly, the latch element 730 is positioned such that the latch protrusion 735 is positioned within both the body recess 715 and the lever recess 725. The spring biasing element 150 is positioned such that a first end is abutted against an end wall of the spring recess 727, while a second end is abutted against the abutment protrusion 707. The shoulder bolts 740 are positioned through the elongate apertures 708, and into at least a portion of the threaded recesses 728.

Interaction between the three sidewalls of the handle recess 724 and the three exterior sidewalls of the base portion 705 maintain the handle element 720 in a desired position relative to the charging handle body 702.

Figure 72:
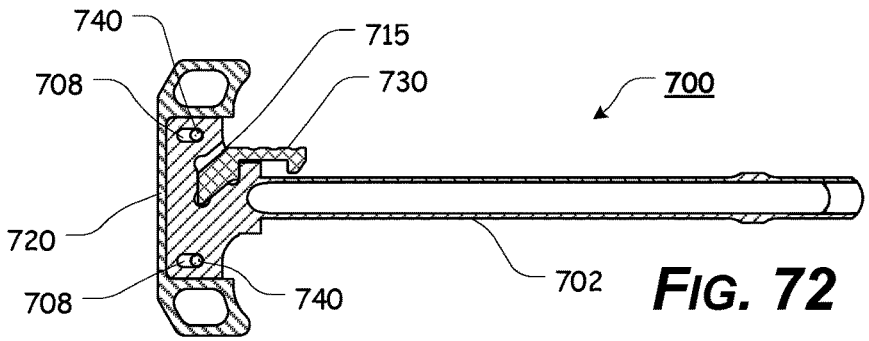
FIG. 72 illustrates a cutaway view showing various components of an exemplary embodiment of an ambidextrous charging handle, wherein the latch element is in a locked position, according to an exemplary embodiment of the present disclosure.
Figure 73:
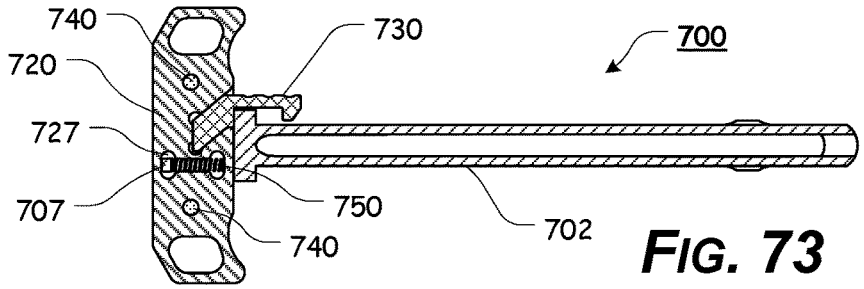
FIG. 73 illustrates a cutaway view showing various components of an exemplary embodiment of an ambidextrous charging handle, wherein the latch element is in a locked position, according to an exemplary embodiment of the present disclosure.
Figure 74:
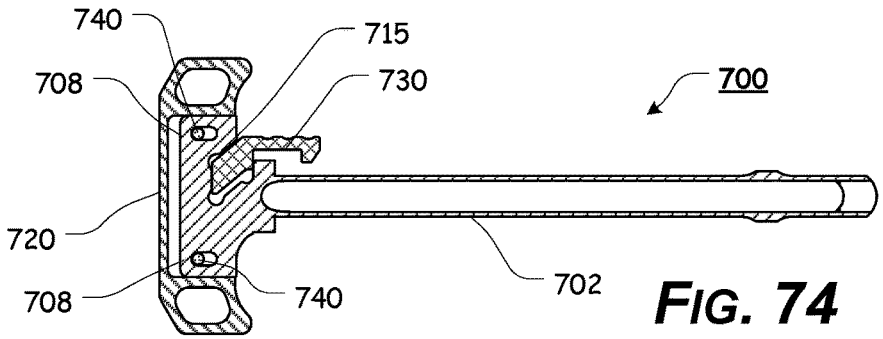
FIG. 74 illustrates a cutaway view showing various components of an exemplary embodiment of an ambidextrous charging handle, wherein the latch element is in an unlocked position, according to an exemplary embodiment of the present disclosure.
Figure 75:
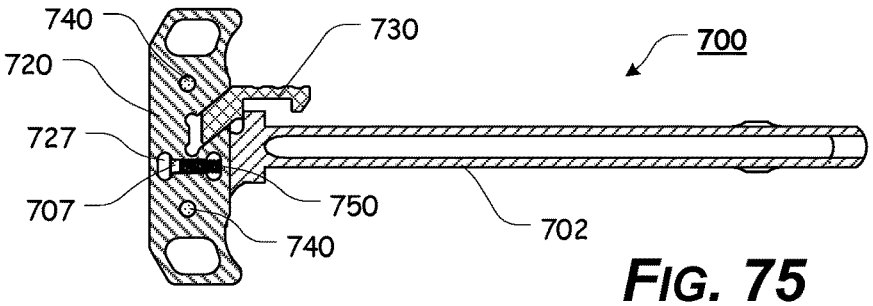
FIG. 75 illustrates a cutaway view showing various components of an exemplary embodiment of an ambidextrous charging handle, wherein the latch element is in an unlocked position, according to an exemplary embodiment of the present disclosure.
Figure 76:
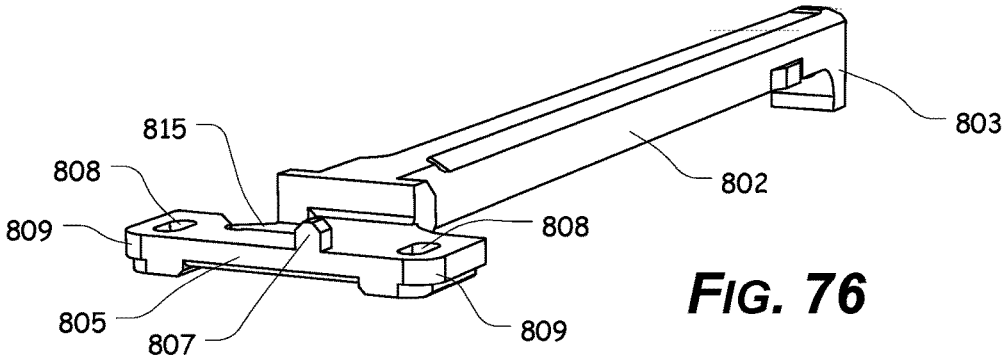
FIG. 76 illustrates a rear, left, perspective view of an exemplary embodiment of charging handle body, according to an exemplary embodiment of the present disclosure.
Figure 77:
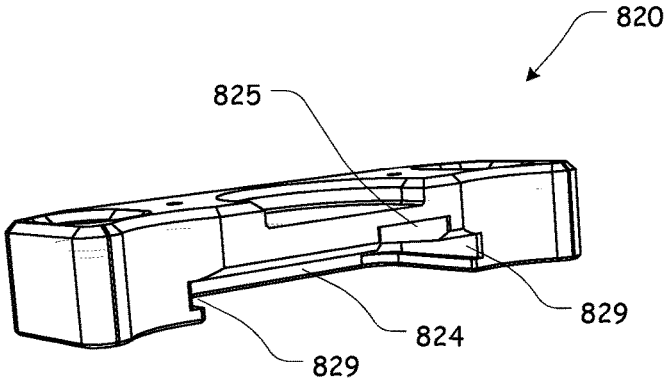
FIG. 77 illustrates a front, left, perspective view of an exemplary embodiment of charging handle body, according to an exemplary embodiment of the present disclosure.
Figure 78:
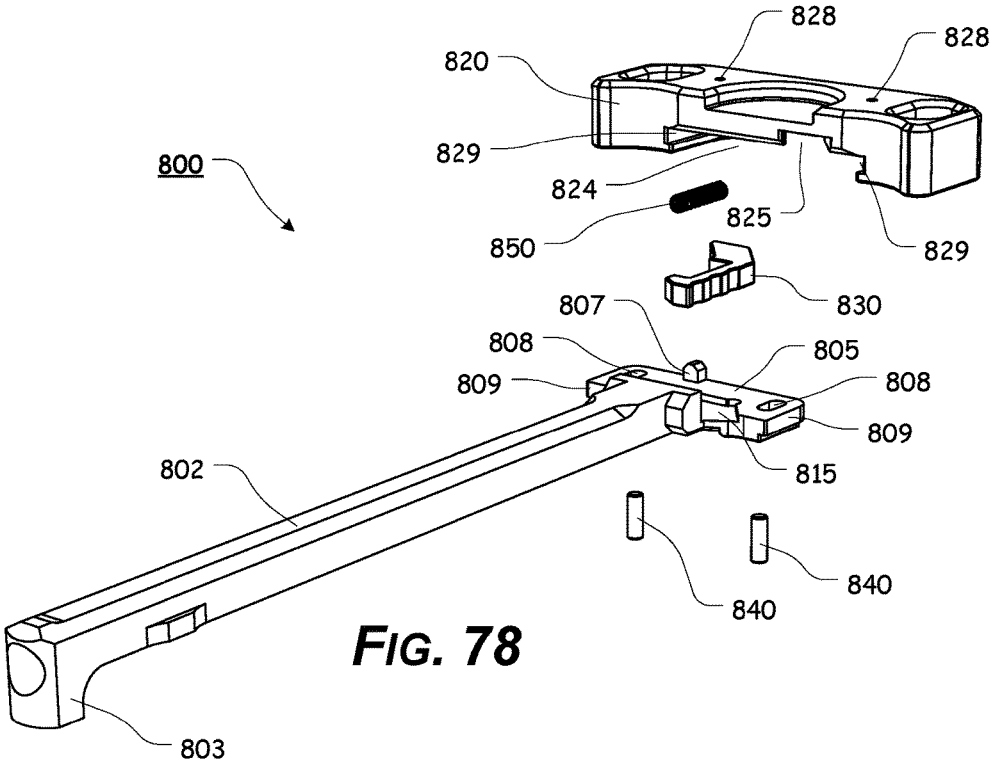
FIG. 78 illustrates an upper, front, left, perspective, exploded view showing various components of an exemplary embodiment of an ambidextrous charging handle, according to an exemplary embodiment of the present disclosure.
Figure 79:
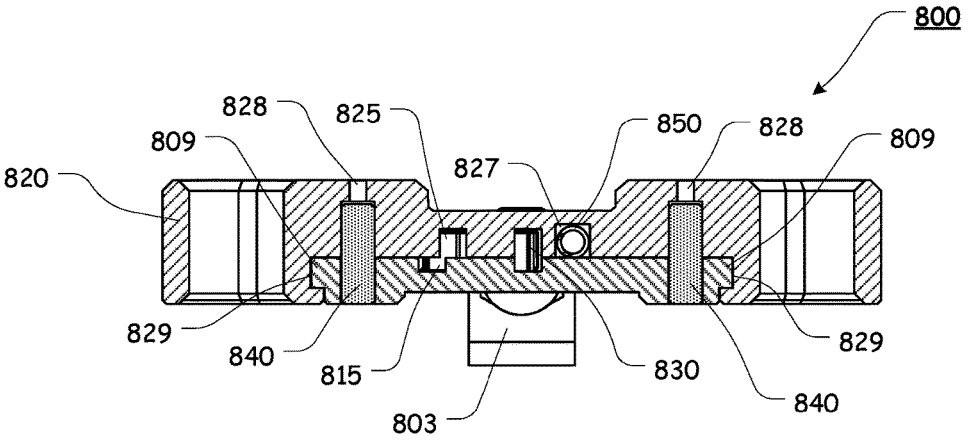
FIG. 79 illustrates a cutaway view showing various components of an exemplary embodiment of an ambidextrous charging handle, according to an exemplary embodiment of the present disclosure.
Figure 80:
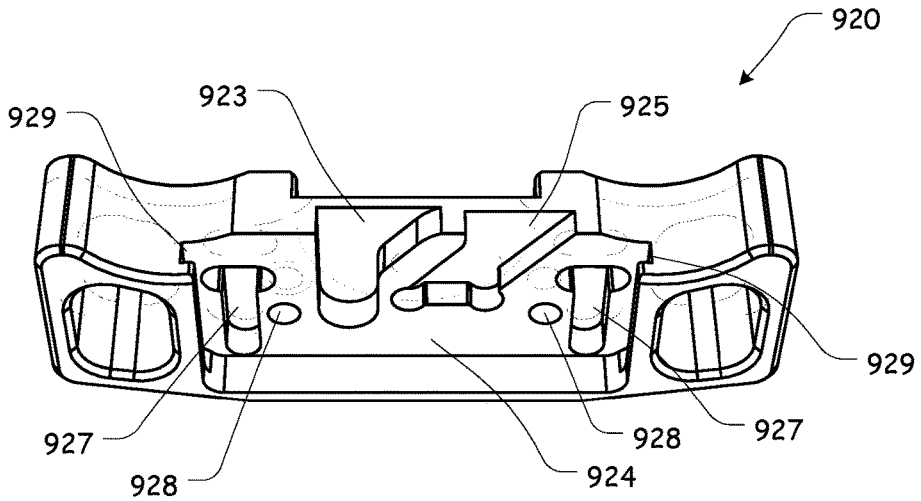
FIG. 80 illustrates a lower, front, perspective view of an exemplary embodiment of a handle element, according to an exemplary embodiment of the present disclosure.
Figure 81:
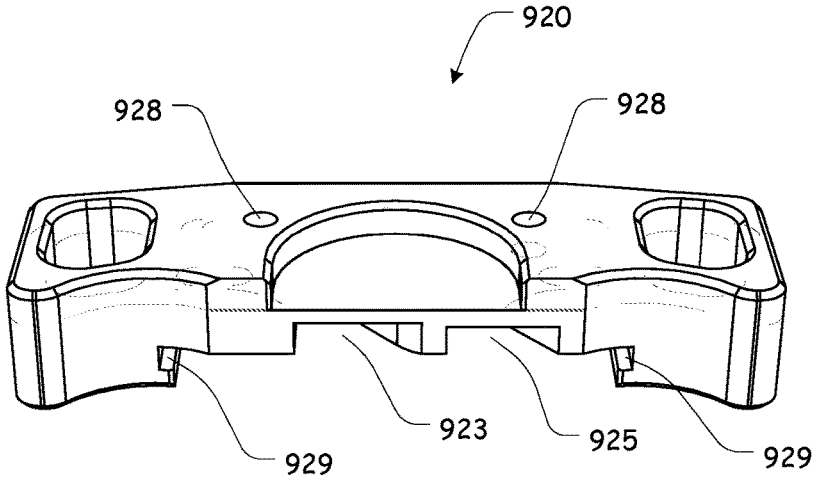
FIG. 81 illustrates an upper, front, perspective view of an exemplary embodiment of a handle element, according to an exemplary embodiment of the present disclosure.
Figure 82:
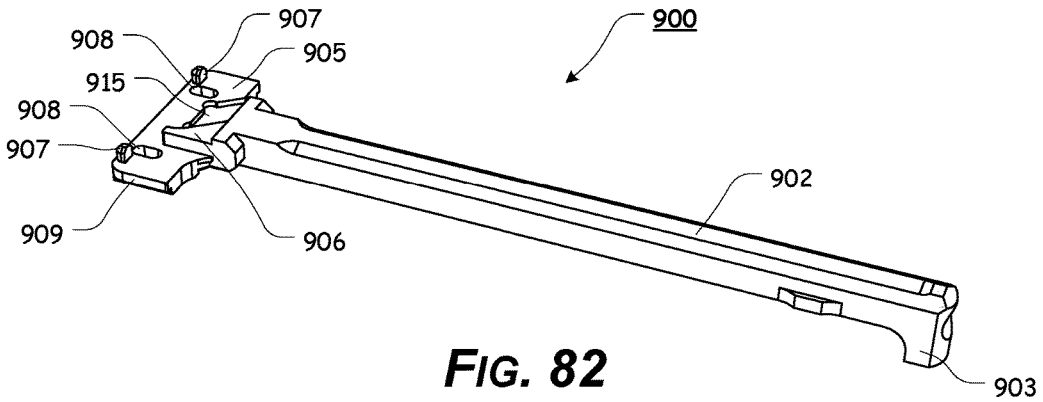
FIG. 82 illustrates an upper, front, left, perspective view of an exemplary embodiment of charging handle body, according to an exemplary embodiment of the present disclosure.
Figure 83:
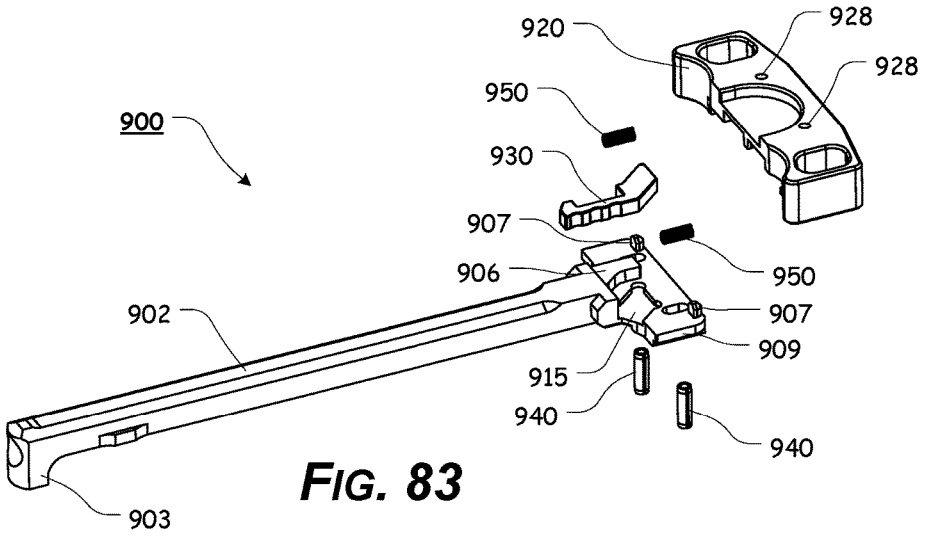
FIG. 83 illustrates an upper, left, perspective, exploded view of an exemplary embodiment of charging handle body, according to an exemplary embodiment of the present disclosure.

Interaction between the shoulder bolts 740 and the elongate apertures 708 allow the handle element 720 to be repeatably slidable between a locked position, as illustrated in FIGS. 72 and 73, and an unlocked position, as illustrated in FIGS. 74 and 75.

Because of the relative angles of the interior sidewalls of the body recess 715 and the lever recess 725 and the exterior sidewalls of the latch protrusion 735, as the handle element 720 is urged from the locked position, as illustrated in FIGS. 72 and 73, to the unlocked position, as illustrated in FIGS. 74 and 75, the rearward movement of the handle element 720 (and the lever recess 725 relative to the stationary body recess 715) causes one or more of the sidewalls of the lever recess 725 to contact one or more of the sidewalls of the latch protrusion 735 and urged the latch protrusion 735 (and the latch element 730) to move laterally, away from the charging handle body 702, within the body recess 715.

If included, the spring biasing element 750 interacts between an interior side wall of the spring recess 727 and the abutment protrusion 707 to bias the handle element 720 two a forward or locked position. As the handle element 720 is urged rearward, the spring bias of the spring biasing element 750 can be overcome to move the latch element 730 from the locked to unlocked position.

In various exemplary embodiments, a spring biasing element 750 comprises one or more compression springs. It should also be understood that the spring biasing element 750 may optionally comprise a spring, a resilient portion of material, or other element capable of providing a biasing force to the handle element 720.

In various exemplary embodiments, various components of the ambidextrous charging handle 700 are substantially rigid and are formed of aluminum. Alternate materials of construction of the various components of the ambidextrous charging handle 700 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the ambidextrous charging handle 700 is a design choice based on the desired appearance and functionality of the ambidextrous charging handle 700.

It should also be understood that the overall size and shape of the ambidextrous charging handle 700 and the various portions thereof is a design choice based upon the desired functionality and/or appearance of the ambidextrous charging handle 700.

FIGS. 76-79 illustrate an exemplary, nonlimiting embodiment of the ambidextrous charging handle 800, according to this disclosure. As illustrated, the exemplary embodiment of the ambidextrous charging handle 800 comprises a charging handle body 802 extending from a base portion 805 to a forward end having a bolt engagement element 803, an abutment protrusion 807, two elongate apertures 808, a body recess 815, a handle element 820 having a handle recess 824, a lever recess 825, an elongate spring recess 827, a latch element 830, and a spring biasing element 850.

It should be appreciated that each of these elements (as well as other, similarly named elements of the ambidextrous charging handle 800) correspond to and operate similarly to similarly named elements, as described herein with reference to the ambidextrous charging handle 700 of FIGS. 67-75. Thus, it should be appreciated that the ambidextrous charging handle 800 may incorporate one or any of the features or elements of the ambidextrous charging handle 700 of FIGS. 67-75 or one or any of the features or elements of the ambidextrous charging handles 100-600.

However, as illustrated in FIGS. 76-79, the shoulder bolts 740 are replaced by pins 840 and the threaded recesses 728 are replaced by apertures 828.

In addition, alignment protrusions 809 extend from various portions of the base portion 805 and corresponding alignment recess 829 are formed in the sidewalls of the handle recess 824. When the ambidextrous charging handle 800 is assembled, the one or more alignment protrusions 809 are aligned with and at least partially within the alignment recesses 829.

With the addition of the alignment protrusions 809 and the alignment recesses 829, the handle element 820 is maintained within a determined position relative to the base portion 805. Thus, the shoulder bolts 740 are not required to maintain the position of the handle 820 relative to the base portion 805. Because relative position is maintained by the interaction of the alignment protrusions 809 and the alignment recesses 829, pins 840 may be used to replace the shoulder bolts 740.

In various exemplary embodiments, the apertures 828 are tapered or include a shoulder so as to limit the position of the pins 840 within the apertures 828. Open end of the apertures 828 may be utilized to apply pressure to install the pins 840 for removal.

FIGS. 80-85 illustrate an exemplary, nonlimiting embodiment of the ambidextrous charging handle 900, according to this disclosure. As illustrated, the exemplary embodiment of the ambidextrous charging handle 900 comprises a charging handle body 902 extending from a base portion 905 to a forward end having a bolt engagement element 903, two elongate apertures 908, a body recess 915, a handle element 920 having a handle recess 924, a lever recess 925, apertures 928, a latch element 930, and pins 940.

It should be appreciated that each of these elements (as well as other, similarly named elements of the ambidextrous charging handle 900) correspond to and operate similarly to similarly named elements, as described herein with reference to the ambidextrous charging handle 800 of FIGS. 76-79. Thus, it should be appreciated that the ambidextrous charging handle 900 may incorporate one or any of the features or elements of the ambidextrous charging handle 800 of FIGS. 76-79.

However, as illustrated in FIGS. 80-85, the two elongate spring recesses 927 and two abutment protrusions 907 are included. Additionally, two spring biasing elements 950 are also included.

In addition, a structural rib 906 extends from a portion of the base portion 905. When assembled, the structural rib 906 fits within a rib recess 923, formed within the handle recess 924 of the handle 920.

Figure 84:
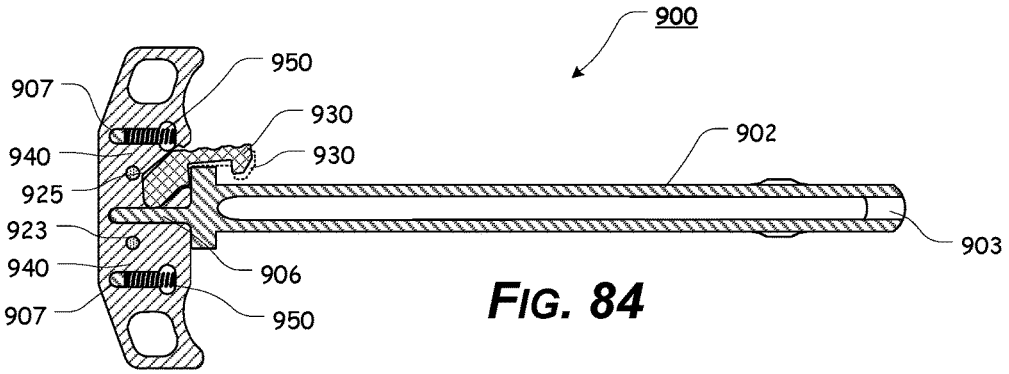
FIG. 84 illustrates a cutaway view showing various components of an exemplary embodiment of an ambidextrous charging handle, wherein the latch element is in a locked or partially locked position, according to an exemplary embodiment of the present disclosure.
Figure 85:
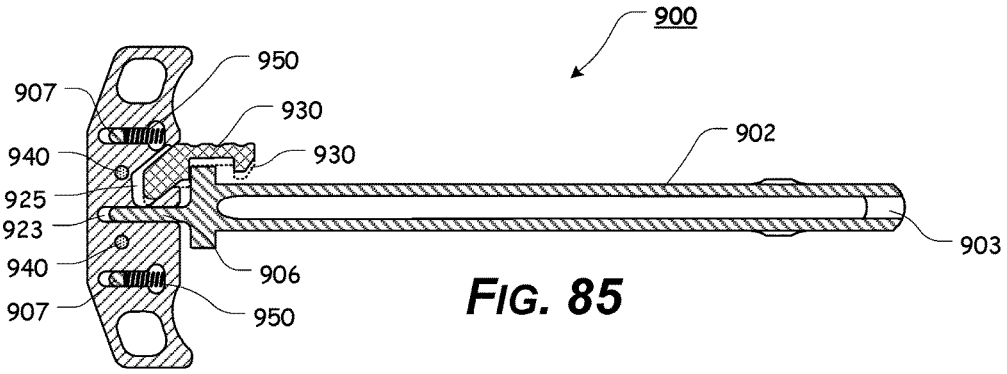
FIG. 85 illustrates a cutaway view showing various components of an exemplary embodiment of an ambidextrous charging handle, wherein the latch element is in an unlocked position, according to an exemplary embodiment of the present disclosure.
Figure 86:
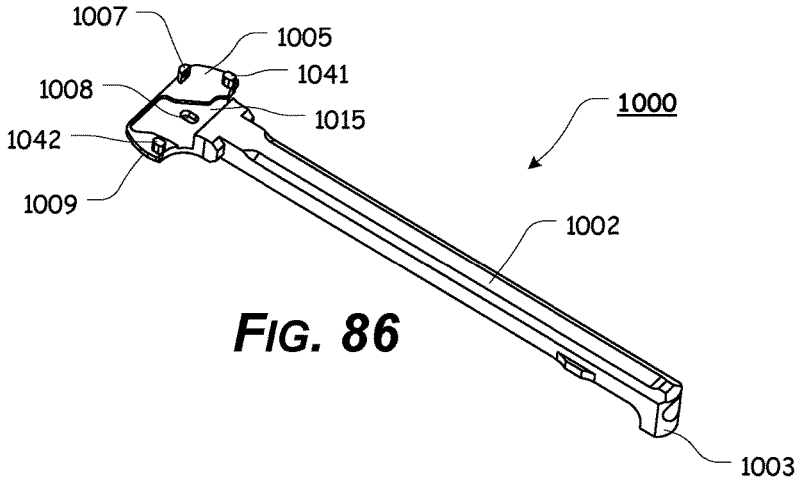
FIG. 86 illustrates an upper, front, right, perspective view of an exemplary embodiment of charging handle body, according to an exemplary embodiment of the present disclosure.
Figure 87:
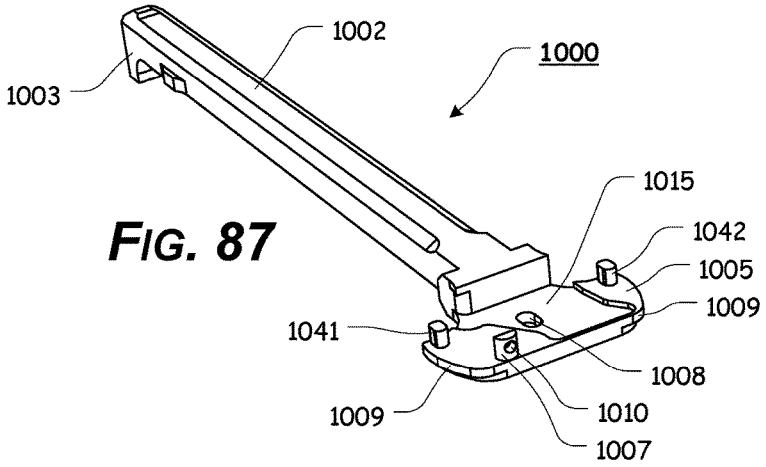
FIG. 87 illustrates an upper, rear, left, perspective view of an exemplary embodiment of charging handle body, according to an exemplary embodiment of the present disclosure.
Figure 88:
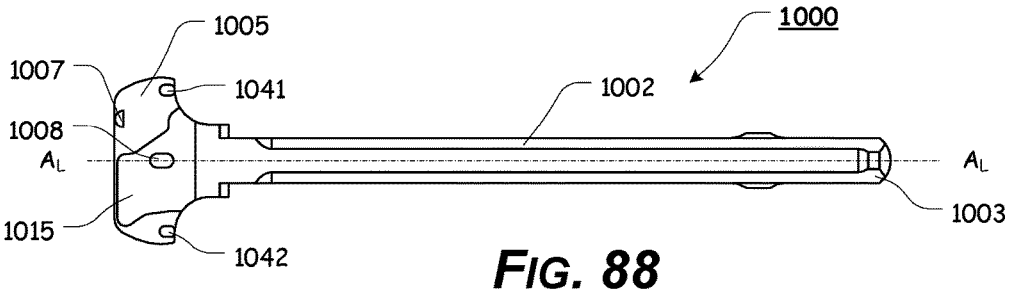
FIG. 88 illustrates a top view of an exemplary embodiment of charging handle body, according to an exemplary embodiment of the present disclosure.
Figure 89:
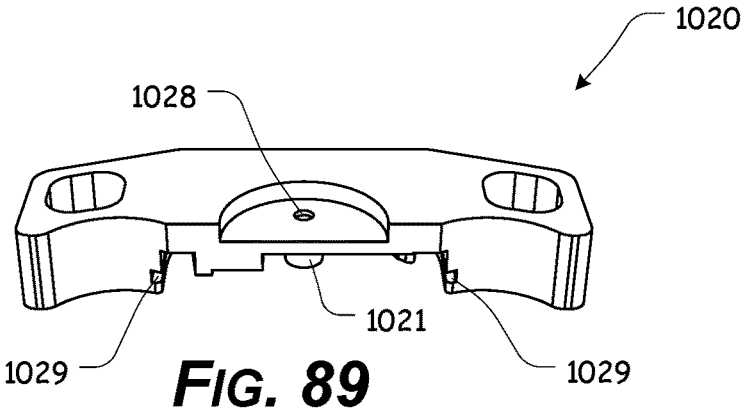
FIG. 89 illustrates an upper, front, perspective view of an exemplary embodiment of a handle element, according to an exemplary embodiment of the present disclosure.
Figure 90:
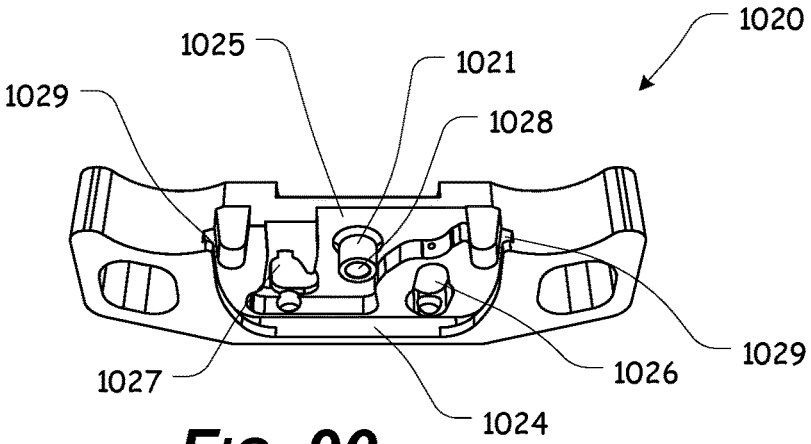
FIG. 90 illustrates a lower, front, perspective view of an exemplary embodiment of a handle element, according to an exemplary embodiment of the present disclosure.
Figure 91:
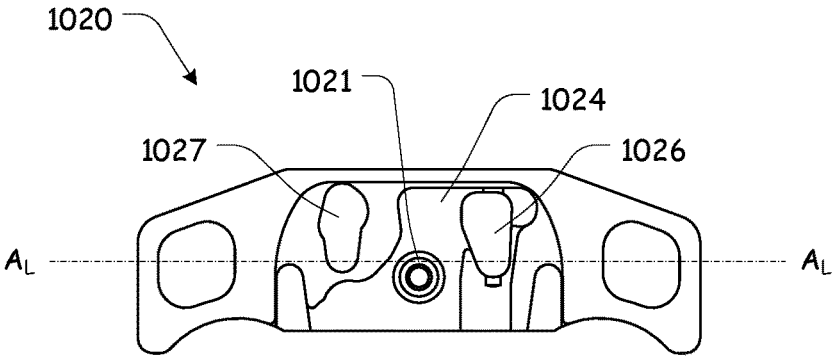
FIG. 91 illustrates a bottom view of an exemplary embodiment of a handle element, according to an exemplary embodiment of the present disclosure.
Figure 92:
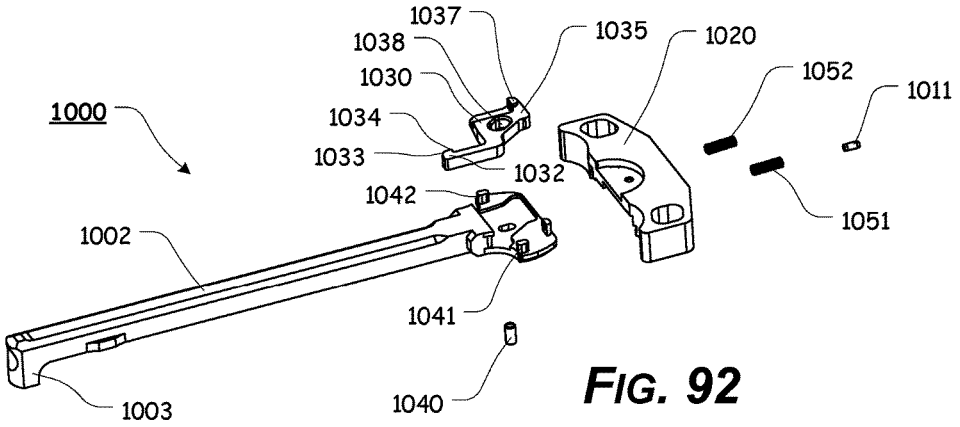
FIG. 92 illustrates an upper, left, perspective, exploded view of an exemplary embodiment of charging handle body, according to an exemplary embodiment of the present disclosure.
Figure 93:
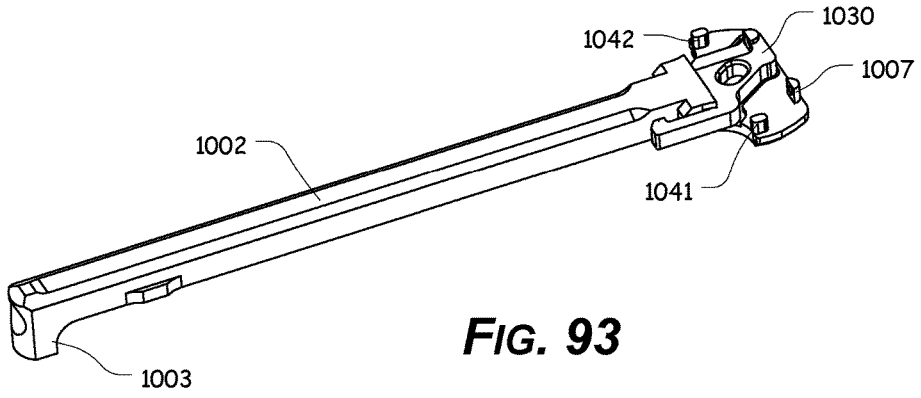
FIG. 93 illustrates an upper, left, perspective, exploded view of certain components of an exemplary embodiment of charging handle body, according to an exemplary embodiment of the present disclosure.

As further illustrated in FIG. 84, the latch element 930 may be able to rotate a sufficient distance to allow the latch element 930 to reengage an upper receiver of a firearm, without requiring movement of the handle element 920.

FIGS. 86-98 illustrate an exemplary, nonlimiting embodiment of the ambidextrous charging handle 1000, according to this disclosure. As illustrated, the exemplary embodiment of the ambidextrous charging handle 1000 comprises a charging handle body 1002, a latch element 1030, a handle element 1020, a first spring biasing element 1051, and a second spring biasing element 1052.

In various exemplary embodiments, the first spring biasing element 1051 and the second spring biasing element 1052 comprise one or more compression springs. It should also be understood that each of the first spring biasing element 1051 and the second spring biasing element 1052 may optionally comprise a spring, a resilient portion of material, or other element capable of providing a biasing force to the handle element 1020 and/or the latch element 1030.

The charging handle body 1002 comprises an elongate portion of material that extends along a longitudinal axis from a base portion 1005 to a forward end having a bolt engagement element 1003.

The base portion 1005 includes a body recess 1015 formed within the base portion 1005 portion, which is shaped so as to slidably receive at least a portion of the latch element 1030 within at least a portion of the body recess 1015. An abutment protrusion 1007 extends from a surface of the base portion 1005, so as to provide an abutment surface for the first spring biasing element 1051. In various exemplary embodiments, the abutment protrusions 1007 includes a protrusion aperture 1010 formed so as to receive a spring placement pin 1011 at least partially therethrough.

An elongate aperture 1008 is formed through a portion of the base portion 1005 and is formed so as to have a longitudinal axis that is substantially parallel to the longitudinal axis of the charging handle body 1002. The elongate aperture 1008 is formed so as to slidably receive at least a portion of a pin 1040 therethrough.

In various exemplary embodiments, the handle element 1020 comprises an elongate portion of material that includes a handle recess 1024 formed within a portion of the handle element 1020. The handle recess 1024 is formed so as to slidably receive at least a portion of the base portion 1005 of the charging handle body 1002 therein. A lever recess 1025 is formed within the handle recess 1024. The lever recess 1025 is shaped so as to slidably and pivotably receive at least a portion of the latch element 1030 within at least a portion of the lever recess 1025.

A first spring recess 1026 and a second spring recess 1027 are each formed within the handle recess 1024 of the lever recess 1025. The first spring recess 1026 is formed so as to allow at least a portion of the body abutment protrusion 1007 to be positioned within the first spring recess 1026, while allowing the first spring biasing element 1051 to also be positioned within the first spring biasing recess 1026.

The second spring recess 1027 is formed so as to allow at least a portion of the latch abutment protrusion 1037 to be positioned within the second spring recess 1027, while allowing the second spring biasing element 1052 to also be positioned within the second spring biasing recess 1027.

A recess 1028 is formed in or through the handle element 1020. The recess 1028 is formed at a location that corresponds to an elongate aperture 1008. The recess 1028 is formed and positioned so as to allow at least a portion of the pin 1040 to be positioned through the elongate aperture 1008 and frictionally or otherwise attached or coupled to the handle element 1020, within a pivot protrusion 1021 that extends from the lever recess 1025.

Once appropriately attached or coupled, a portion of the pin 1040 is positioned within the elongate aperture 1008 to allow the handle element 1020 to be repeatably slidable relative to the base portion 1005 of the charging handle body 1002. The handle element 1020 is also at least partially rotatable relative to the base portion 1005 of the charging handle body 1002. Thus, the handle element 1002 is both slidable and rotatable relative to the base portion 1005 of the charging handle body 1002.

The latch element 1030 extends from a first portion to a second portion and a claw 1032 (including a ramp surface 1033 and shoulder 1034) is formed proximate the first portion of the latch element 1030. A latch protrusion 1035 is formed proximate the second portion of the latch element 1030. The latch protrusion 1035 is formed so as to be at least partially received within and interact with the body recess 1015 and the lever recess 1025.

An elongate pivot aperture 1038 is formed through the latch element 1030. The elongate pivot aperture 1038 is formed so as to allow the latch element 1030 to be pivotably positioned about the pivot protrusion 1021, via positioning of at least a portion of the pivot protrusion 1021 through the elongate pivot aperture 1038.

Once appropriately attached or coupled, a portion of the pivot protrusion 1021 is positioned within the elongate pivot aperture 1038 to allow the latch element 1030 to be repeatably slidable relative to the handle element 1020. The latch element 1030 is also at least partially rotatable relative to the handle element 1020, via interaction of at least a portion of the pivot protrusion 1021 and the elongate pivot aperture 1038. Thus, the latch element 1030 is both slidable and rotatable relative to the handle element 1020.

A latch abutment protrusion 1037 extends from the latch element 1030, so as to provide an abutment surface for the second spring biasing element 1052.

A first stop protrusion 1041 and a second stop protrusion 1042 extend from at least a portion of the base portion 1005. The first stop protrusion 1041 and the second stop protrusion 1042 extend so as to interact with recesses in the handle element 1020 to limit forward or rotational travel of the handle element 1020 relative to the base portion 1005.

The latch element 1030 is positioned such that movement of the handle element 1020 along the longitudinal axis of the charging handle 1000 (forward and backward) produces lateral (side-to-side), non-pivoting, movement of the latch element 1030 relative to the longitudinal axis of the charging handle 1000.

Movement of one side or the other side of the handle element 1020 rearward (rotational movement of the handle element 1020), relative to the longitudinal axis of the charging handle 1000, also produces lateral (side-to-side), non-pivoting, movement of the latch element 1030 relative to the longitudinal axis of the charging handle 1000.

During assembly, the latch element 1030 is positioned such that the pivot protrusion 1021 is positioned within the elongate pivot aperture 1038 of the latch element 1030. The handle element 1020 is slidably positioned, via interaction of alignment protrusions 1009 extending from the base portion 1005 and alignment recesses 1029 formed within at least a portion of the lever recess 1025.

Interaction between the alignment protrusions 1009 and the alignment recesses 1029 maintain the handle element 1020 in a desired position relative to the charging handle body 1002.

The handle element 1020 is slidably positioned such that the pivot aperture 1028 is aligned with the elongate aperture 1008. When the handle element 1020 is appropriately positioned, the pin 1040 is positioned at least partially through the elongate aperture 1008 and frictionally or otherwise secured within the pivot aperture 1028.

Figure 94:
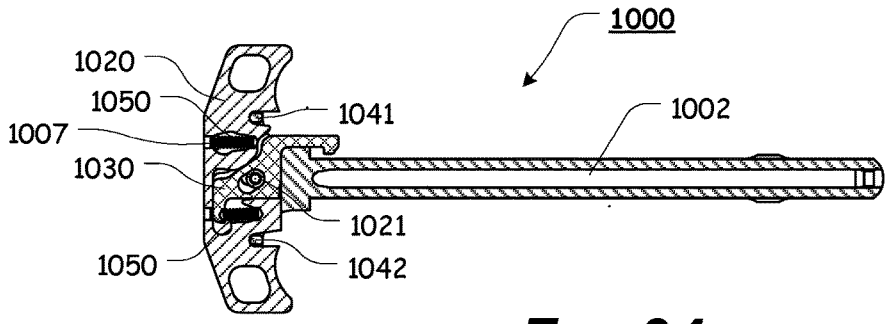
FIG. 94 illustrates a cutaway view showing various components of an exemplary embodiment of an ambidextrous charging handle, wherein the latch element is in a locked position, according to an exemplary embodiment of the present disclosure.
Figure 96:
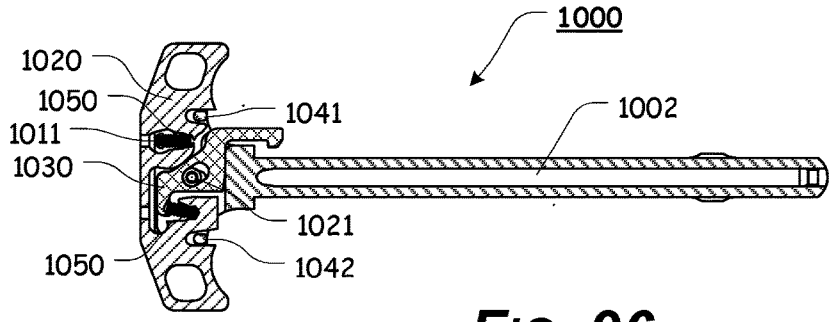
FIG. 96 illustrates a cutaway view showing various components of an exemplary embodiment of an ambidextrous charging handle, wherein the latch element is in an unlocked position, according to an exemplary embodiment of the present disclosure.
Figure 97:
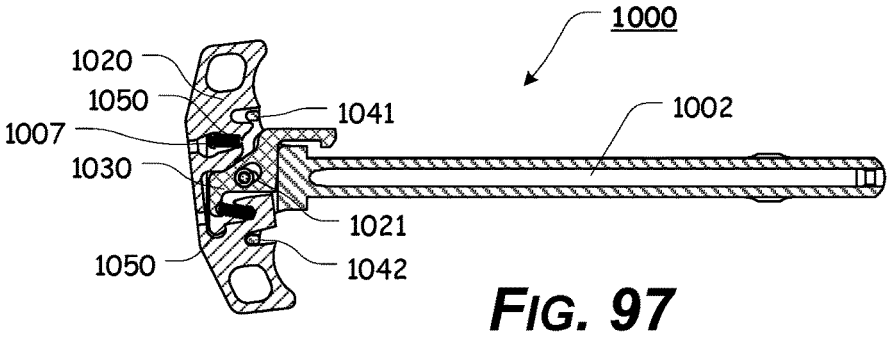
FIG. 97 illustrates a cutaway view showing various components of an exemplary embodiment of an ambidextrous charging handle, wherein the latch element is in an unlocked position, according to an exemplary embodiment of the present disclosure.
Figure 98:
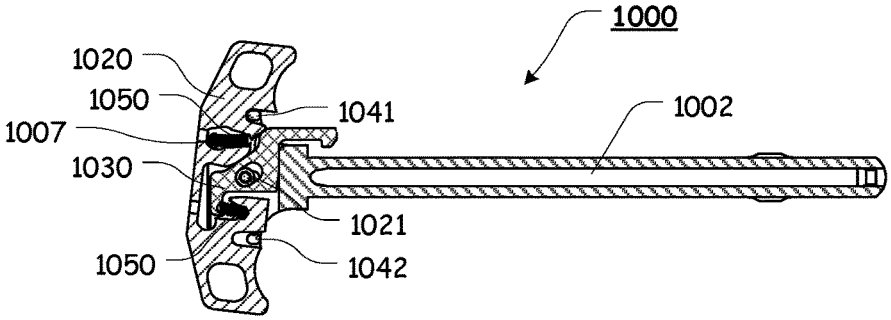
FIG. 98 illustrates a cutaway view showing various components of an exemplary embodiment of an ambidextrous charging handle, wherein the latch element is in an unlocked position, according to an exemplary embodiment of the present disclosure.
Figure 99:
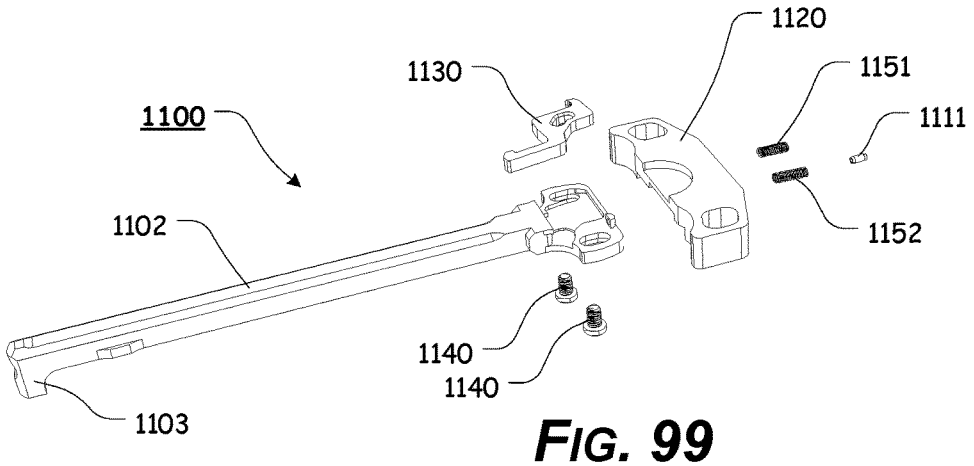
FIG. 99 illustrates an upper, left, perspective, exploded view of an exemplary embodiment of charging handle body, according to an exemplary embodiment of the present disclosure.
Figure 100:
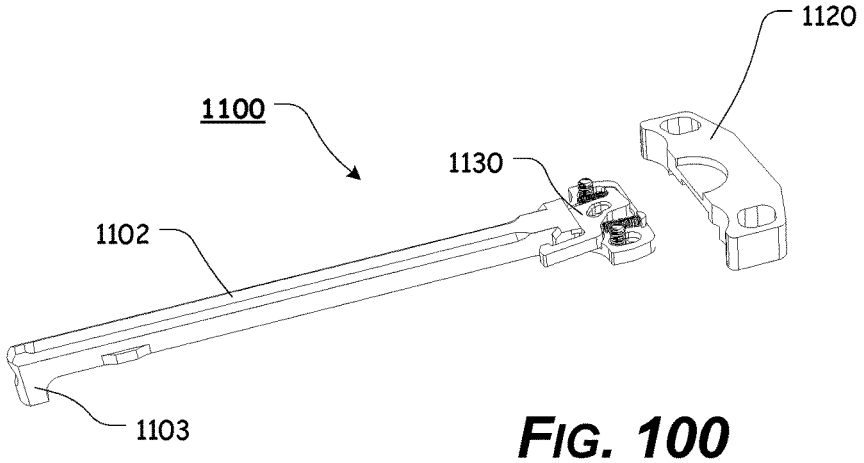
FIG. 100 illustrates an upper, left, perspective, exploded view of certain components of an exemplary embodiment of charging handle body, according to an exemplary embodiment of the present disclosure.
Figure 101:
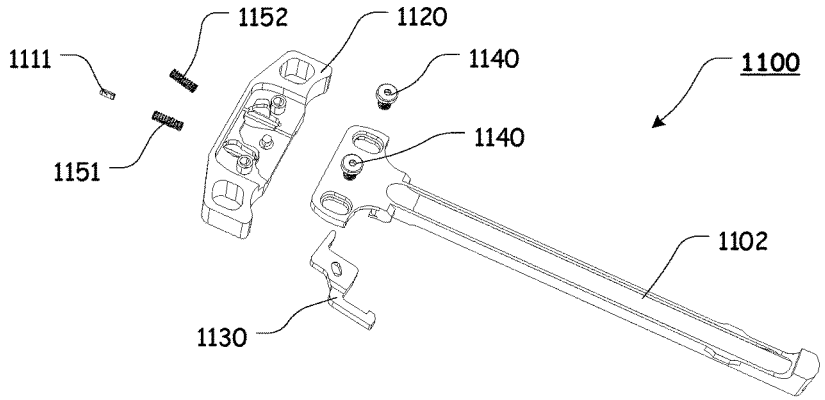
FIG. 101 illustrates an lower, perspective, exploded view of an exemplary embodiment of charging handle body, according to an exemplary embodiment of the present disclosure.
Figure 102:
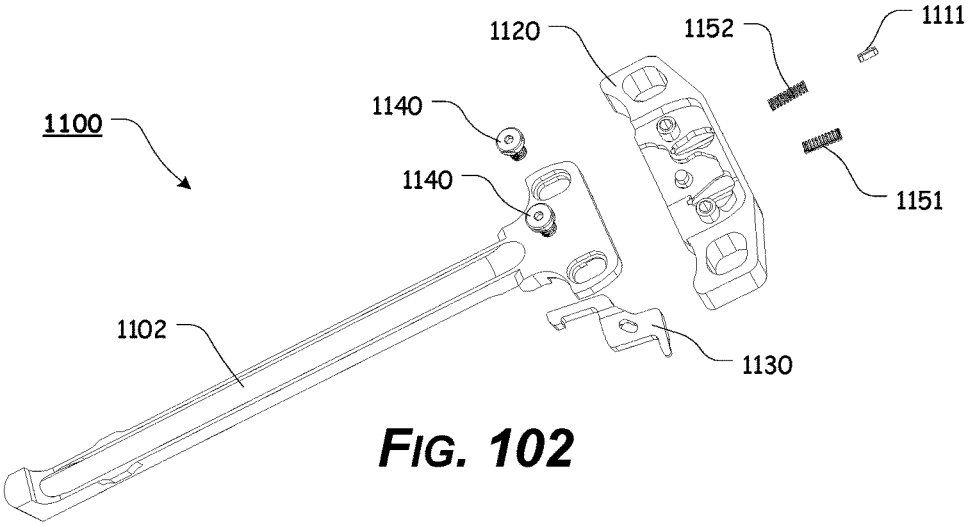
FIG. 102 illustrates an lower, perspective, exploded view of an exemplary embodiment of charging handle body, according to an exemplary embodiment of the present disclosure.
Figure 103:
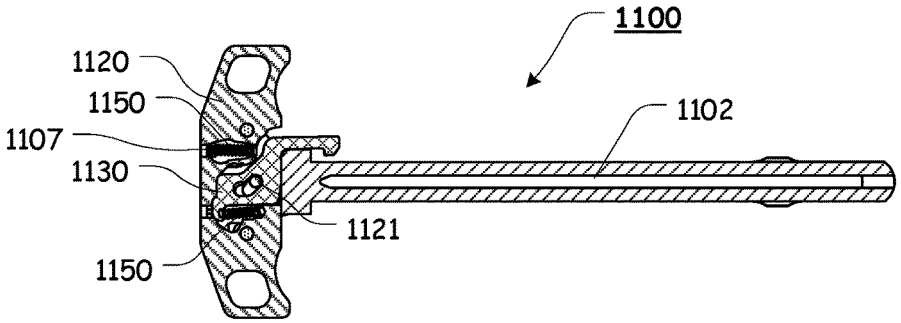
FIG. 103 illustrates a cutaway view showing various components of an exemplary embodiment of an ambidextrous charging handle, wherein the latch element is in a locked position, according to an exemplary embodiment of the present disclosure.
Figure 104:
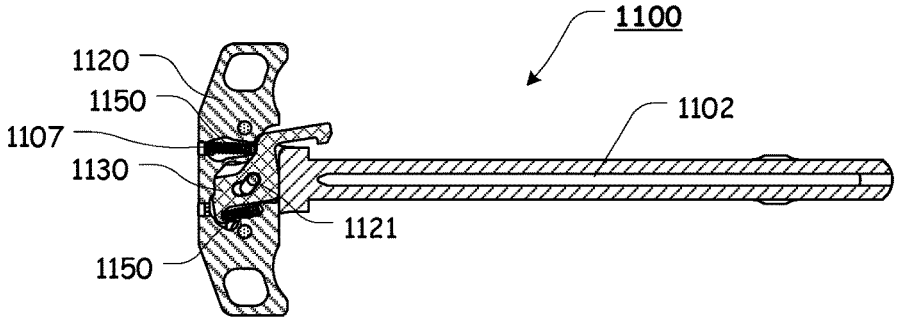
FIG. 104 illustrates a cutaway view showing various components of an exemplary embodiment of an ambidextrous charging handle, wherein the latch element is rotated to an unlocked position, according to an exemplary embodiment of the present disclosure.

Interaction between the pin 1040 and the elongate aperture 1008 allows the handle element 1020 to be repeatably slidable between a locked position, as illustrated in FIG. 94, and an unlocked position, as illustrated in FIGS. 96-98.

The first spring biasing element 1051 is urged through a first spring assembly aperture in the rear of the handle element 1020 and into the first spring recess 1026. The first spring biasing element 1051 is positioned such that a first end is abutted against an end wall of the first spring recess 1026, while a second end is abutted against the abutment protrusion 1007. Once positioned, a spring placement pin 1011 urged through a protrusion aperture 1010 and at least partially into the first spring recess 1026, so as to be at least partially positioned within at least certain of the coils of the first spring biasing element 1051. In this manner, the spring placement pin 1011 is able to help maintain the desired position of the first spring biasing element 1051 within the first spring recess 1026. Thus, the first spring biasing element 1051 is able to provide spring biasing to the handle element 1020.

The second spring biasing element 1052 is urged through a second spring assembly aperture in the rear of the handle element 1020 and into the second spring recess 1027. The second spring biasing element 1052 is positioned such that a first end is abutted against an end wall of the second spring recess 1027, while the second end is abutted against the latch abutment protrusion 1037. Thus, the second spring biasing element 1052 is able to provide spring biasing to the latch element 1030, independent of movement of the handle element 1020.

Because of the relative angles of the interior sidewalls of the body recess 1015 and the lever recess 1025 and the exterior sidewalls of the latch protrusion 1035, as the handle element 1020 is urged from the locked position, as illustrated in FIG. 94, to the unlocked position, along the longitudinal axis of the charging handle body 1002, as illustrated in FIG. 96, the rearward movement of the handle element 1020 (and the lever recess 1025 relative to the stationary body recess 1015) causes one or more of the sidewalls of the lever recess 1025 to contact one or more of the sidewalls of the latch protrusion 1035 and urged the latch protrusion 1035 (and the latch element 1030) to move laterally, away from the charging handle body 1002, within the body recess 1015.

Figure 95:
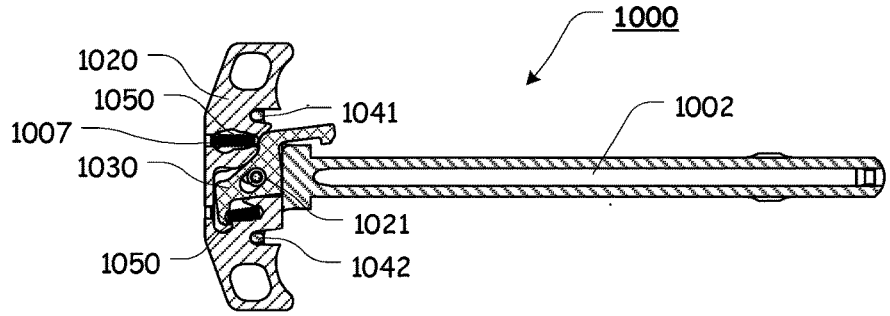
FIG. 95 illustrates a cutaway view showing various components of an exemplary embodiment of an ambidextrous charging handle, wherein the latch element is in a locked position and the latch element is rotated to an unlocked position, according to an exemplary embodiment of the present disclosure.

Because the latch element 1030 is able to pivot, relative to the pivot protrusion 1021, the latch element 1030 can be urged, in a rotational manner, to the unlocked position, as illustrated in FIG. 95, if the ramped surface 1033 of the latch element 1030 is urged away from the charging handle body 1002.

If, as illustrated in FIG. 97, the left side of the handle element 1020 is urged rearward, the handle element 1020 is able to be urged from the locked position, as illustrated in FIG. 94, to the unlocked position, as illustrated in FIG. 97. The rearward movement of the left side of the handle element 1020 causes one or more of the sidewalls of the lever recess 1025 to contact one or more of the sidewalls of the latch protrusion 1035 and urged the latch protrusion 1035 (and the latch element 1030) to move laterally, away from the charging handle body 1002, within the body recess 1015.

Rotational movement of the handle element 1020 is limited by interaction between the second stop protrusion 1042 and a recess of the handle element 1020.

If, as illustrated in FIG. 98, the right side of the handle element 1020 is urged rearward, the handle element 1020 is able to be urged from the locked position, as illustrated in FIG. 94, to the unlocked position, as illustrated in FIG. 98. The rearward movement of the right side of the handle element 1020 causes one or more of the sidewalls of the lever recess 1025 to contact one or more of the sidewalls of the latch protrusion 1035 and urged the latch protrusion 1035 (and the latch element 1030) to move laterally, away from the charging handle body 1002, within the body recess 1015.

Rotational movement of the handle element 1020 is limited by interaction between the second first protrusion 1041 and a recess of the handle element 1020.

In various exemplary embodiments, various components of the ambidextrous charging handle 1000 are substantially rigid and are formed of aluminum. Alternate materials of construction of the various components of the ambidextrous charging handle 1000 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the ambidextrous charging handle 1000 is a design choice based on the desired appearance and functionality of the ambidextrous charging handle 1000.

It should also be understood that the overall size and shape of the ambidextrous charging handle 1000 and the various portions thereof is a design choice based upon the desired functionality and/or appearance of the ambidextrous charging handle 1000.

FIGS. 99-104 illustrate an exemplary, nonlimiting embodiment of the ambidextrous charging handle 1100, according to this disclosure. As illustrated, the exemplary embodiment of the ambidextrous charging handle 1100 comprises a charging handle body 1102 extending from a base portion 1105 to a forward end, a handle element 1120, and a latch element 1130.

It should be appreciated that each of these elements (as well as other, similarly named or numbered elements of the ambidextrous charging handle 1100) correspond to and operate similarly to similarly named elements, as described herein with reference to the ambidextrous charging handle 1000 of FIGS. 86-98. Thus, it should be appreciated that the ambidextrous charging handle 1100 may incorporate one or any of the features or elements of the ambidextrous charging handle 1000 of FIGS. 86-98.

However, as illustrated in FIGS. 99-104, the pin 1040 is replaced by two fasteners 1140. Additionally, the recess 1028 is replaced by two threaded protrusion apertures and the pivot protrusion 1021 is replaced by an extending pivot pin.

It should also be appreciated that a more detailed explanation of the instructions regarding how to install and use the ambidextrous charging handle are not provided herein because it is believed that the level of description provided herein will provide sufficient information to enable one of ordinary skill in the art to understand and practice the disclosure, as described.

While the charging handle of the present disclosure has been described in conjunction with the exemplary embodiments outlined above, the foregoing description of exemplary embodiments of the disclosure, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A charging handle assembly, comprising:

a charging handle body that extends from a base portion;

a handle element, wherein said handle element is attached or coupled to said base portion of said charging handle body, such that said handle element is repeatably slidable relative to said base portion of said charging handle body and is also at least partially rotatable relative to said base portion of said charging handle body; and a latch element having an elongate pivot aperture formed therethrough, wherein said latch element is repeatably slidable relative to said handle element and is also at least partially rotatable relative to said handle element, and wherein at least a portion of said latch element is formed so as to interact with at least a portion of said handle recess such that rotational or longitudinal movement of said handle element relative to a longitudinal axis of said charging handle produces lateral, translational movement of said latch element relative to said charging handle body.

2. The charging handle of claim 1, wherein rotational movement of said latch element does not induce movement of said handle element.

3. The charging handle of claim 1, further comprising a first spring biasing element that biases said handle element toward a locked position.

4. The charging handle of claim 1, further comprising a second spring biasing element that biases said latch element toward a locked position.

5. The charging handle of claim 1, further comprising a claw formed proximate a first portion of said latch element.

6. The charging handle of claim 1, wherein said handle element is attached or coupled to said base portion of said charging handle body via interaction of a pin positioned through an elongate aperture formed through a portion of said base portion and attached or coupled to said handle element.

7. The charging handle of claim 6, wherein said elongate aperture formed through a portion of said base portion is formed so as to have a longitudinal axis that is substantially parallel to said longitudinal axis of said charging handle body.

8. The charging handle of claim 1, further comprising a first stop protrusion and a second stop protrusion, wherein said first stop protrusion and said second stop protrusion extend from at least a portion of said base portion so as to interact with said handle element to limit forward or rotational movement of said handle element relative to said base portion.

9. The charging handle of claim 1, wherein said base portion is a substantially T-shaped base portion.

10. A Charging Handle Assembly, comprising:

a charging handle body extending from a base portion;

a handle element attached or coupled to said base portion, such that said handle element is repeatably slidable relative to said base portion and is also at least partially rotatable relative to said base portion; and a latch element having an elongate pivot aperture formed therethrough, wherein said latch element is repeatably slidable relative to said handle element and is also at least partially rotatable relative to said handle element, and wherein at least a portion of said latch element is formed so as to interact with at least a portion of said handle recess such that rotational or longitudinal movement of said handle element relative to a longitudinal axis of said charging handle produces lateral, translational movement of said latch element relative to said charging handle body.

11. The charging handle of claim 10, further comprising a first spring biasing element that biases said handle element toward a locked position.

12. The charging handle of claim 10, further comprising a second spring biasing element that biases said latch element toward a locked position.

13. The charging handle of claim 10, wherein said handle element is attached or coupled to said base portion of said charging handle body via interaction of a pin positioned through an elongate aperture formed through a portion of said base portion and attached or coupled to said handle element.

14. The charging handle of claim 10, wherein rotational movement of said latch element does not induce movement of said handle element.

15. The charging handle of claim 10, wherein said base portion is a substantially T-shaped base portion.

16. A charging handle assembly, comprising:

a charging handle body having a base portion;

a handle element slidably and at least partially rotatable relative to said base portion; and a latch element slidable and at least partially rotatable relative to said handle element, and wherein at least a portion of said latch element is formed so as to interact with at least a portion of said handle recess such that rotational or longitudinal movement of said handle element relative to a longitudinal axis of said charging handle produces lateral, translational movement of said latch element relative to said charging handle body.

17. The charging handle of claim 16, further comprising a first spring biasing element that biases said handle element toward a locked position and a second spring biasing element that biases said latch element toward a locked position.

18. The charging handle of claim 16, wherein rotational movement of said latch element does not induce movement of said handle element.

19. The charging handle of claim 16, wherein said handle element is attached or coupled to said base portion of said charging handle body via interaction of a pin positioned through an elongate aperture formed through a portion of said base portion and attached or coupled to said handle element.

20. The charging handle of claim 19, wherein said elongate aperture formed through a portion of said base portion is formed so as to have a longitudinal axis that is substantially parallel to said longitudinal axis of said charging handle body.

* * * * *